US009153425B2

(12) United States Patent
Van Berkel

(10) Patent No.: US 9,153,425 B2
(45) Date of Patent: Oct. 6, 2015

(54) DEVICE FOR HIGH SPATIAL RESOLUTION CHEMICAL ANALYSIS OF A SAMPLE AND METHOD OF HIGH SPATIAL RESOLUTION CHEMICAL ANALYSIS

(75) Inventor: Gary J. Van Berkel, Clinton, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 876 days.

(21) Appl. No.: 12/873,412

(22) Filed: Sep. 1, 2010

(65) Prior Publication Data

US 2012/0053065 A1 Mar. 1, 2012

(51) Int. Cl.
*H01J 49/04* (2006.01)

(52) U.S. Cl.
CPC ..... *H01J 49/0431* (2013.01)

(58) Field of Classification Search
None
See application file for complete search history.

(56) References Cited

U.S. PATENT DOCUMENTS 4,848,165 A 7/1989 Bartilson et al.
6,164,144 A * 12/2000 Berg ..... 73/863.21
6,231,737 B1 * 5/2001 Ramsey et al. ..... 204/451
6,576,193 B1 6/2003 Cui et al.
2002/0190202 A1 12/2002 Liang
2003/0027359 A1 2/2003 Hudak et al.
2003/0059345 A1 * 3/2003 Gilbert et al. ..... 422/100

FOREIGN PATENT DOCUMENTS

WO WO 2010/55466 A1 5/2010

* cited by examiner

*Primary Examiner* — Christopher M Gross
(74) *Attorney, Agent, or Firm* — Novak Druce Connolly Bove + Quigg LLP

(57) ABSTRACT

A system and method for analyzing a chemical composition of a specimen are described. The system can include at least one pin; a sampling device configured to contact a liquid with a specimen on the at least one pin to form a testing solution; and a stepper mechanism configured to move the at least one pin and the sampling device relative to one another. The system can also include an analytical instrument for determining a chemical composition of the specimen from the testing solution. In particular, the systems and methods described herein enable chemical analysis of specimens, such as tissue, to be evaluated in a manner that the spatial-resolution is limited by the size of the pins used to obtain tissue samples, not the size of the sampling device used to solubilize the samples coupled to the pins.

10 Claims, 21 Drawing Sheets

DEVICE FOR HIGH SPATIAL RESOLUTION CHEMICAL ANALYSIS OF A SAMPLE AND METHOD OF HIGH SPATIAL RESOLUTION CHEMICAL ANALYSIS

STATEMENT REGARDING FEDERALLY SPONSORED RESEARCH

This invention was made with government support under Contract No. DE-AC05-00OR22725 awarded by the U.S. Department of Energy. The government has certain rights in this invention.

FIELD OF THE INVENTION

This invention is drawn to systems and methods for high spatial-resolution analysis of the chemical composition of a specimen.

BACKGROUND OF THE INVENTION

Many types of surface sampling probes have been employed to deliver analytes to an analytic instrument, such as a mass spectrometer. Such surface sampling probes include probes employing thermal desorption, laser desorption and confined liquid extraction. Methods of liquid extraction surface sampling probes include those disclosed in Gary J. Van Berkel et al., "Thin-Layer Chromatography and Electrospray Mass Spectroscopy Coupled Using a Surface Sampling Probe," Anal. Chem. 2002, 74, pp. 6216-6223; Keiji G. Asano et al., "Self-aspirating atmospheric pressure chemical ionization source for direct sampling of analytes on surfaces and in liquid solutions," Rapid Commun. Mass Spectrom. 2005, 19, pp. 2305-2312; and U.S. Pat. No. 6,803,566 to Gary J. Van Berkel. Despite the existing liquid extraction probe technology, there is currently no efficient means of obtaining high resolution compositional analysis of a sample.

SUMMARY OF THE INVENTION

A method and system for analyzing a chemical composition of a specimen is described. The system can include at least one pin; a sampling device configured to contact a liquid with a specimen on the at least one pin to form a testing solution; and a stepper mechanism configured to move the at least one pin and the sampling device relative to one another. The stepper mechanism can be configured to move the at least one pin and the sampling device such that the sampling device sequentially dissolves samples on at least two pins. The tip(s) of the at least one pin can include at least one of a solid phase microextraction (SPME) coating, taper, a prong and a punch.

The system can be an analytical instrument for determining a chemical composition of the specimen from the testing solution. The sampling device can dispense the testing solution into the analytical instrument, such as a mass spectrometer, an ionization source, a separation method, or a combination thereof.

The sampling device can include a capillary tube defining an outer perimeter of a capillary in fluid communication with an external orifice of the sampling device. The external orifice can be adapted for forming a meniscus with a liquid in the capillary. The sampling device can also include an inner capillary tube disposed within the capillary tube, where the inner capillary defines an outer perimeter of an inner capillary. The capillary and the inner capillary can be in fluid communication at a distal end of the sampling device. The system can be adapted so that fluid flows through the inner capillary and the testing solution flows through the capillary. In the alternative, the system can be adapted so that fluid flows through the capillary and the testing solution flows through the inner capillary.

The at least one pin can be an array of pins. The array of pins can be an array of regularly spaced pins. The array of pins can have a regular center-to-center spacing in a direction, and a maximum dimension across a distal end of the sampling device in the direction is more than twice the regular spacing in the direction.

A method of analyzing a chemical composition of a specimen is also disclosed. The method can include contacting a pin with a specimen to cause a sample from the specimen to become coupled to said pin; dissolving a sample coupled to the pin in a solvent to form a testing solution; and analyzing the testing solution to determine a chemical composition of the sample. The dissolving step can include providing a sampling device having an external orifice; and contacting the solvent with the sample through the external orifice.

The method can include the solvent forming a meniscus, having a meniscus surface, across the external orifice. During the dissolving step, only the sample, the pin or both, can interrupt the meniscus surface.

The contacting step can include contacting a plurality of pins with a specimen to cause a sample from the specimen to become coupled to each of the plurality of pins. The method can include moving at least one of the plurality of pins relative to another of the plurality of pins prior to the dissolving.

The tips of the plurality of pins can define a surface during the contacting step. In some example, for at least one pin, the moving can include moving a pin tip above the surface. In some examples, for at least one pin, the moving includes increasing a lateral distance between at least one pair of adjacent pins. The dissolving and analyzing steps can be repeated until each sample on each of the plurality of pins is evaluated by the analytical device. The method can also include plotting a property of a chemical component for each of the samples to correspond with an arrangement of the plurality of pins.

BRIEF DESCRIPTION OF THE DRAWINGS

A fuller understanding of the present invention and the features and benefits thereof will be obtained upon review of the following detailed description together with the accompanying drawings, in which:

FIG. 11 is a perspective view of an embodiment of the invention where the pins are transferred one at a time from an impalement plate to a sampling plate prior to analysis of the sample on each pin.

DETAILED DESCRIPTION OF THE INVENTION

Figure 1:
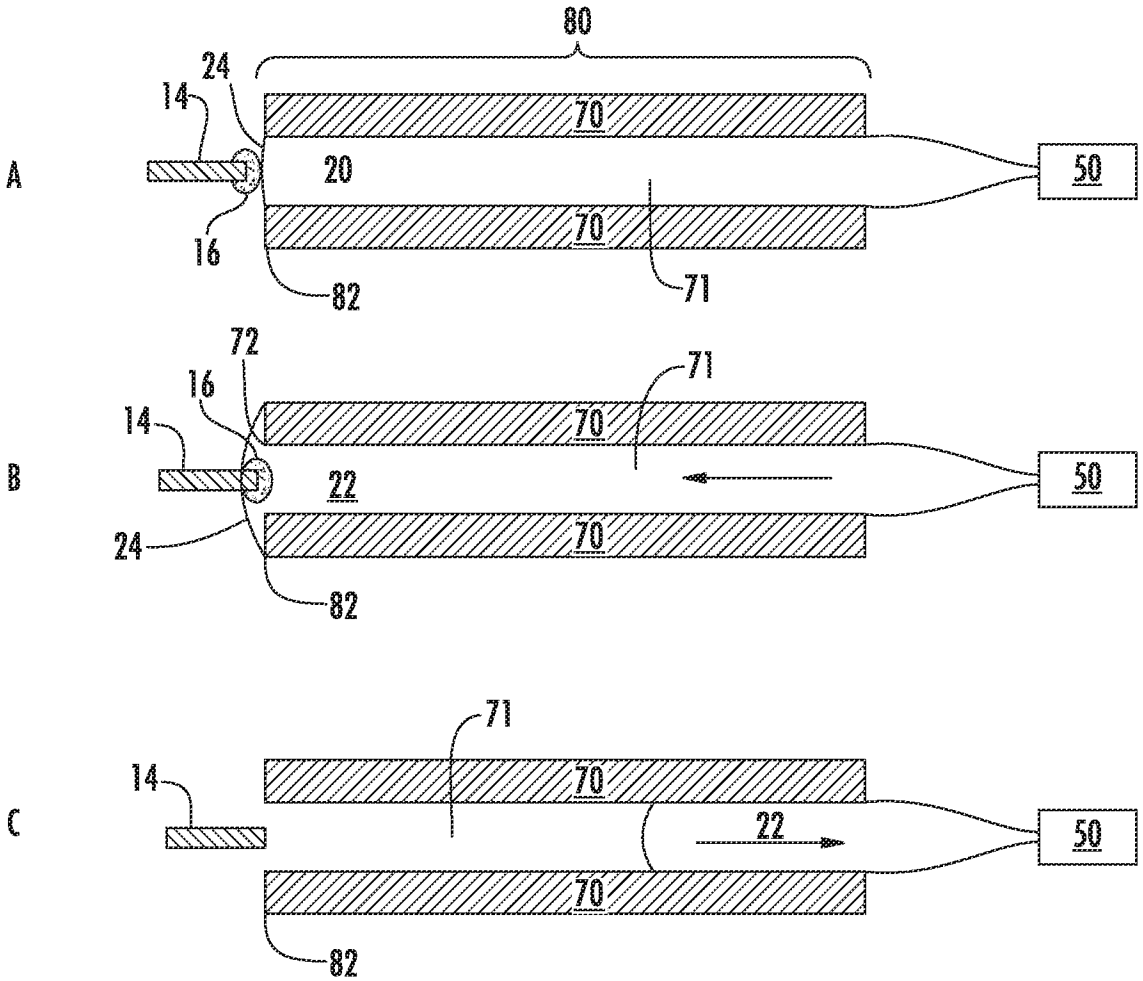
FIGS. 1A-C are longitudinal cross-sections of a single capillary sampling device and sample bearing pin according to the invention.

The present invention is directed to systems and methods for high spatial-resolution analysis of the chemical composition of a specimen. In particular, the systems and methods described herein enable chemical analysis of specimens, such as tissue, to be evaluated in a manner that the spatial-resolution is limited by the size of the pins used to obtain tissue samples, not the size of the sampling device used to solubilize the samples coupled to the pins. It is noted that like and corresponding elements mentioned herein and illustrated in the drawings are generally referred to by the same reference numeral. It is also noted that proportions of various elements in the accompanying figures are not drawn to scale to enable clear illustration of elements having smaller dimensions relative to other elements having larger dimensions.

As used herein, a "sampling probe" and "sampling device" are used interchangeably and refer to any device configured to contact a liquid, i.e., a solvent, with a sample to form a testing solution and dispense the testing solution from the device.

As shown in the Figures, the system 10 for analyzing a chemical composition of a specimen can include at least one pin 14 and a sampling device 80 configured to contact a liquid 20 with a specimen 16 on the pin(s) 14 to form a testing solution 22. The system 10 can also include a stepper mechanism 90 configured to move the pin(s) 14 and the sampling device 80 relative to one another.

As used herein, "pin" has its standard meaning and should be understood to include any generally thin and slender object with any of a variety of tips useful for retaining a sample. Exemplary pin tips can include one or more of a solid phase microextraction (SPME) coating, a taper, a protruding prong and a punch. The pin(s) 14 used herein can have a diameter, or maximum cross-sectional dimension, of less than 10 mm, less than 4 mm, less than 2 mm, less than 1 mm, less than 500 μm, less than 250 μm, less than 100 μm or less than 50 μm. In addition, the tip of the pin(s) 14 can be tapered and have a diameter, or maximum cross-sectional dimension of less than 10 mm, less than 4 mm, less than 2 mm, less than 1 mm, less than 500 μm, less than 250 μm, less than 100 μm, or less than 50 μm, less than 25 μm, less than 1 μm, less than 500 nm, less than 100 nm or less than 50 nm. For example, in some embodiments, the pin(s) 14 can be atomic force microscopy probes having a tip diameter of approximately 50 nm or less.

As used herein, "stepper" has its standard meaning in the art and should be understood to include any device or combination of devices for changing the relative position between the sampling device 80 and a pin 14. For example, a stepper can include a robot arm that sequentially moves the sampling device such that the distal end is proximate to a tip of a pin and the moves the sampling device so that testing solution can be dispensed into an analytical instrument. A stepper can also include a surface on which an array of pin(s) 14 is supported that moves the array laterally and transversely under a sampling device.

The system 10 can also include an analytical instrument 50 for determining a chemical composition of said specimen from said testing solution 22. As will be understood, the invention includes any of a variety of sampling devices 80 and analytical instruments 50, which can be in liquid communication in a variety of ways. For example, although FIGS. 1 and 9 show single capillary sampling devices 80 with the analytical instrument 50 attached to a proximal end of the sampling device 80, it is envisioned that a single capillary sampling device 80 can be used in an embodiment, such as that shown in FIG. 13, where the testing solution 22 is discharged to the analytical instrument 50 through the external orifice 72. Similarly, although FIGS. 5-8 show dual capillary sampling devices 80 with the analytical instrument 50 attached to a proximal end of the sampling device 80, it is envisioned that a dual capillary sampling device 80 can be used in an embodiment, such as that shown in FIG. 13, where the testing solution 22 is discharged to the analytical instrument 50 through the external orifice 72.

The analytical instrument 50 can be any instrument utilized for analyzing analytes in solution. Exemplary analytical instruments include, but are not limited to, mass spectrometers, ionization sources, separation methods, and combinations thereof. Exemplary ionization sources include, but are not limited to electrospray ionization, atmospheric pressure chemical ionization, atmospheric pressure photoionization or inductively coupled plasma. Exemplary separation methods include, but are not limited to liquid chromatography, solid phase extraction, HPLC, capillary electrophoresis, or any other liquid phase sample cleanup or separation process. Exemplary mass spectrometers ("MS") include, but are not limited to, sector MS, time-of-flight MS, quadrupole mass filter MS, three-dimensional quadrupole ion trap MS, linear quadrupole ion trap MS, Fourier transform ion cyclotron resonance MS, orbitrap MS and toroidal ion trap MS.

The system 10 can be designed so that the sampling device 80 dispenses the testing solution 22 into the analytical device 50. The sampling device 80 can be in continuous liquid communication with the analytical device 50, as shown in FIGS. 2, 3A and 4-8. Alternately, as shown in FIGS. 13A-E, the sample device 80 can be placed in liquid communication with the analytical device 50 for the dispensing process and can be out of liquid communication with the analytical device 50 at other times, such as during the contacting phase when the testing solution 22 is formed. It should be understood that variations of FIGS. 2, 3A and 4-8 can be developed where the sample device is not in continuous liquid communication with the analytical device 50 without deviating from the intended scope of the invention.

As shown in FIGS. 1, 2, 3A and 4-9, the sampling device 80 can include a capillary tube 70 defining an outer perimeter of a capillary 71 in fluid communication with an external orifice 72 of the sampling device 80. The external orifice 72 can be shaped to form a meniscus 24 with a liquid 20 or testing solution 22 in the capillary 71. For example, the external orifice 72 can be circular, elliptical or another shape adapted to forming a meniscus 24 with the liquid 20. The external orifice 72 can be located at a distal end 82 of the sampling device 80. It is also understood that the example shown in FIGS. 13A-E can be a single capillary embodiment and that the single capillary can include a disposable pipette tip.

As shown in FIGS. 2, 3A and 4-8, the sampling device 80 can also include an inner capillary tube 60 disposed within the capillary tube 70. The inner capillary tube 60 can define an outer perimeter of an inner capillary 61. The capillary 71 and the inner capillary 61 can be in fluid communication at a distal end 82 of the sampling device 80. In some examples, such as that shown in FIG. 2, the fluid 20 flows through the capillary 71 and the testing solution 22 flows the inner capillary 61. In other examples (not shown), the flow is reversed and the fluid 20 flows through the inner capillary 61 and the testing solution 22 flows through the capillary 71.

The system can include a plurality of pins, which can be in the form of a two dimensional array of pins. The stepper 90 can be configured to move the at least one pin 14, the sampling device 80, or both 14, 80, such that the sampling device 80 sequentially forms test solutions 22 using samples 16 on at least two pins 14. For example, FIG. 3B depicts a sampling methodology where the sampling device 80 sequentially forms test solutions 22 from top-to-bottom in a first column of the pin array and then top-to-bottom in subsequent adjacent columns of the pin array.

The array of pins can be an array of regularly spaced pins. As used herein, "regular spacing" and "regularly spaced" are used interchangeably and refer to spacing where the distance between adjacent pins in a line is equal or approximately equal along the length of the line, as shown in FIGS. 3B, 3D and 3E. Regular spacing also refers to instances where the same pin is part of two or more lines with regular spacing, as shown in FIG. 3E. Each line of regularly spaced pins can include at least 3 pins, at least 10 pins, at least 20 pins, or at least 100 pins.

The array of pins 14 can have a regular center-to-center spacing in a direction of a line of pins. The maximum dimension 84 across a distal end 82 of the sampling device 80 in the direction can be at least twice the regular center-to-center spacing in the direction.

The invention is also drawn to a method of analyzing a chemical composition of a specimen. The method can include contacting a pin 14 with a specimen to cause a sample 16 from the specimen to become coupled to the pin 14; dissolving the sample 16 coupled to the pin 14 in a solvent 20 to form a testing solution 22; and analyzing the testing solution 22 to determine a chemical composition of the sample 16. The analyzing step can be carried out using any analytical device 50 useful to assist with determining a chemical composition of a sample 16.

The dissolving step can include providing a sampling device 80 having an external orifice 72, such as those described herein, and contacting the solvent 20 with the sample 16 through the external orifice 72. The solvent 20 can form a meniscus 24 across the external orifice 72. As shown in FIGS. 1, 2, 11 and 13, during the dissolving step, only the sample 16, the pin 14 or both 14, 16, can interrupt the meniscus 24. In other examples, such as those shown in FIGS. 3A, 4, 5, 6, 7 and 8, the meniscus 24 can be interrupted by additional bodies, such as a plate 12. Examples where the meniscus 24 is interrupted include standard methods of sampling using conventional sealing surface sampling probes or liquid microjunction surface sampling probes.

Figure 12:
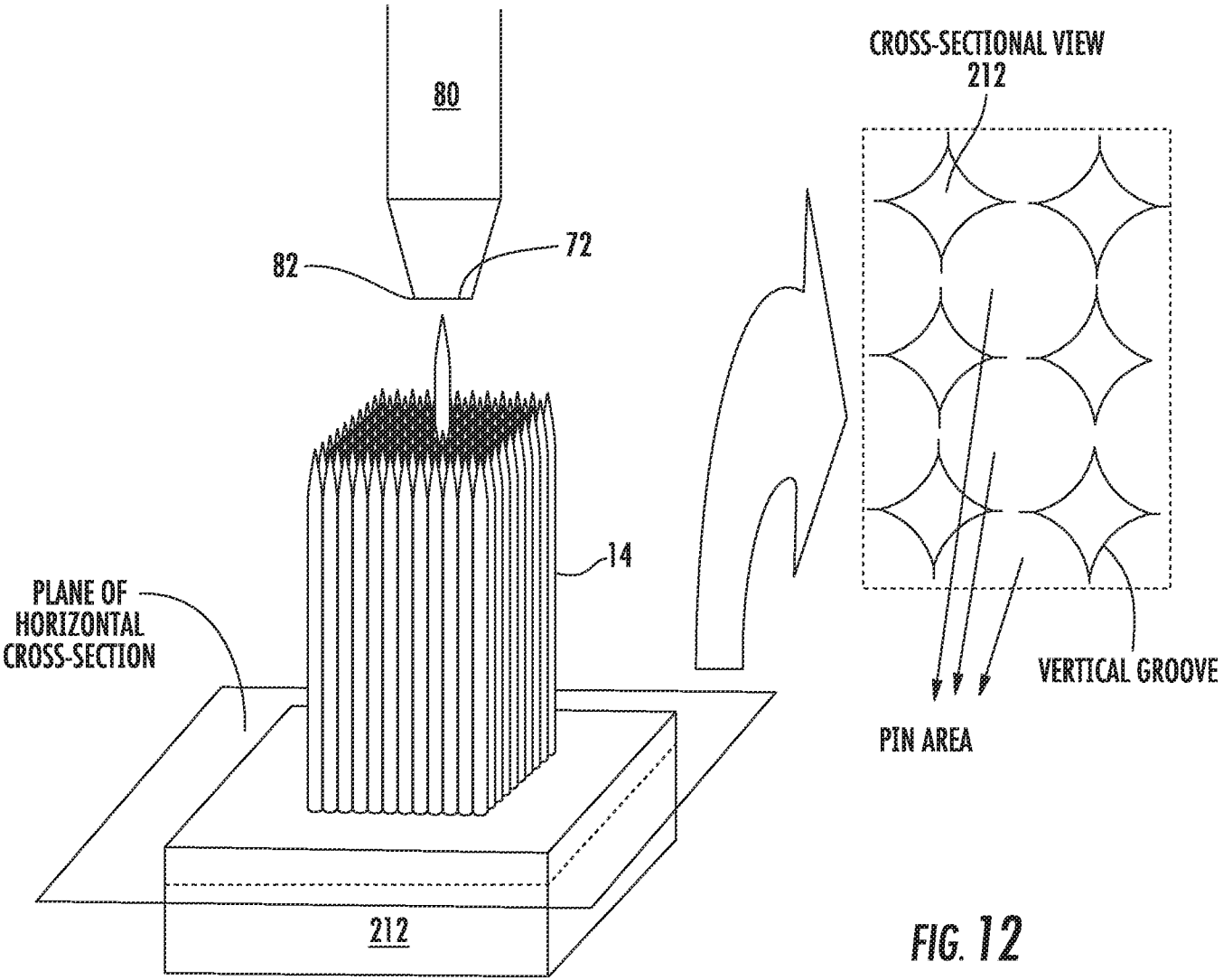
FIG. 12 is a perspective view of an embodiment of the invention where the individual pins are raised above a surface formed by the remaining pins and the raised pin is sampled.

The contacting step can include contacting tips of a plurality of pins 14 with a specimen to cause a sample 16 from the specimen to become coupled to each of the plurality of pins 14. In such an embodiment, the method can also include moving at least one of the plurality of pins 14 relative to another of the plurality of pins 14 prior to the dissolving step. Some examples of this approach are shown in FIGS. 10, 11 and 12. In one example, the tips of the plurality of pins 14 can define a surface during the contacting step and the moving step comprises moving at least one pin tip above the surface, such as shown in FIG. 12. In another example, the tips of the plurality of pins 14 can define a surface during the contacting step and the moving step includes increasing a lateral distance between at least one pair of adjacent pins 14, such as shown in FIGS. 10 and 11. As used herein, "lateral" movement of the pins refers to movement in a direction perpendicular to a longitudinal axis of the pin being moved. In some examples, each of the pins with a sample being analyzed is moved prior to the dissolving step for that pin. In some examples, the dissolving and analyzing steps are repeated until each sample on each of the plurality of pins is analyzed.

The method can also include plotting any exogenous or endogenous property related to the surface being evaluated, including a property of a molecule or chemical component for each of the samples to correspond with an arrangement of the plurality of pins. Properties of interest include, concentration of a molecule and relative ratio of two molecules (such as compound and reaction product of the compound).

For example, the property of interest can be the concentration of a chemical component, such as a pharmaceutical and its metabolites, in the sample. By arranging the data for each sample to correspond to the location of the pin to which it was coupled within the array of pins, a two dimensional surface can be plotted. As will be understood, because the spacing of the pins can be adjusted after the samples are coupled to the pins, the resolution of these surface plots is limited by the size of the pins, not the size of the sampling device. In addition, the possibility of contamination can be reduced because the sampling instrument does not necessarily produce a continuous flow of testing solution.

Referring to FIGS. 3A-3D, in one example of the method and apparatus described herein, the system 10 includes a sampling probe 80, a pin assembly 11, and a stepper mechanism 90. The sampling device 80 can be configured to form a testing solution 22 by contacting a liquid 20, either continuously or discretely, with a sample 16. The testing solution 22 can then be supplied to an analytical device 50 either continuously or discretely.

In some examples, the system 10 can include pin assembly 11 that includes a plate 12 and an array of pins 14 located on a top surface 13 of the plate 12. Each pin 14 in the array of pins can protrude from the top surface 13 of the plate 12. The pins 14 in the array of pins can be affixed to the surface of the plate 12. Typically, the top surface 13 of the plate 12 is a planar surface and a bottom surface of each pin 14 is coplanar with bottom surfaces of other pins 14. Each pin 14 in the array of pins can protrude in a direction normal to the top surface 13 of the plate 12. The thickness of the plate 12 can be from 1 mm to 5 cm, although lesser and greater thicknesses can also be employed. The plate 12 can be made of a rigid material such as metal or inert hard plastic that does not dissolve in the liquid 20, i.e., the eluent or solvent.

The pins 14 within the array of pins can be arranged in a two-dimensional array with a regular spacing. For example, the pins 14 within the array of pins can be arranged in a rectangular two-dimensional array. In some examples, the spacing among the pins 14 can be determined in relation to the dimensions of the liquid extraction surface sampling probe 80 to be employed in conjunction therewith. Each pin 14 can have a cross-sectional area of a circle, an ellipse, a polygonal shape, or any closed shape. While the present invention is described employing pins 14 having circular cross-sectional areas and a definable diameter, the present invention can be employed with pins of any kind of cross-sectional area.

The pin assembly 11 can be employed to collect an array of samples 16 from a target, which can include a biological material or a chemical material. In case the specimen includes a biological material, the pins 14 of the pin assembly 11 can be pushed against a surface of the biological material such that small pieces of the biological material are coupled to the tips of the pins 14, e.g., the biological material can be impaled. Optionally, the biological material can be planarized before impalement with the pins 14. Exemplary methods of planarization include deformation or slicing. The chemical material can be in a solid phase, a liquid phase, or in a gas phase. Upon acquisition of samples 16 at the tip of the pins 14 the pin assembly 11 can be coupled to the stepper mechanism 80. The stepper mechanism 80 can sequentially move each sample 16 proximate to the external orifice 72 located at the distal end 82 of the sampling device 80.

Exemplary sampling probes 80 include, but are not limited to, liquid extraction surface sampling probes such as liquid microjunction surface sampling probes, sealed surface sampling probes and variants thereof. In some examples, such as that shown in FIG. 3, the sampling probe 80 can include an inner capillary 61 laterally surrounded by an inner capillary tube 60. The system 10 can include an analytical instrument 50 such as an electrospray ionization source 52 and/or a mass spectrometer 54. The inner tube 60 can be surrounded by a capillary 71, which is typically an annular volume between the inner capillary tube 60 and a capillary tube 70. As used herein, the term "liquid" can be used interchangeably with "eluent" or "solvent," and the phrase "testing solution" can be used interchangeably with "eluate."

Where the sampling device 80 includes a capillary tube 70 and an inner capillary tube 60, dimensions of a diameter of the inner capillary 61 can be from 50 microns to 400 microns. Typical dimensions of the inner diameter of the outer capillary 71 can be from 100 microns to 700 microns. Typical dimension of an outer diameter of the outer capillary 71 can be from 150 microns to 1 mm. The cross-sectional areas of the inner capillary tube 60 and/or the outer capillary tube 70 can be circular, elliptical, superelliptical (i.e., shaped like a superellipse), or even polygonal. Typical maximum dimensions, e.g., an outer diameter or twice a semimajor axis, of a distal end of a sampling device 80 along any direction within a plane parallel to a distal end of the sampling device 80 can be from 200 microns to 2 mm, although lesser and greater dimensions can also be employed.

Where both are present, the inner capillary 61 and an outer capillary 71 can be in fluid communication with each other at a distal end 82 of the sampling device 80. Thus, liquid 20 in the inner capillary 61 can contact the sample 16 to form the testing solution 22 which then flows through the outer capillary 71. Alternately, this flow pattern can be reversed so that the liquid 20 flows through the outer capillary 71 contacts the sample 16 to form the testing solution 22, which then flows through the inner capillary 61.

The dimensions of the distal end 82 of the sampling device 80 and the spacing of the pins 14 in the pin assembly 11 are selected so that only a single pin 14 within the array of pins is contacted with the fluid 20 accessible through the external orifice 72 when the sampling device 80 is brought into proximity of the tip of a pin 14. Specifically, a tip of a single pin 14 within the array of pins is inserted within the sampling device 80 probe when the external orifice 72 is brought into proximity with that pin 14. The tip of the single pin 14 within the array of pins can be inserted within the inner capillary 61 when the external orifice 72 is brought into proximity with that pin 14. The sample 16 under analysis can, but need not necessarily, be placed within the inner capillary 61.

Although not necessary, a liquid microjunction interface 66 can be formed between the top surface 13 of the plate 12 and the external orifice 72 of the sampling device 80. Alternately, the sample 16 can penetrate through the meniscus 24 of the liquid 20 and/or testing solution 22 when the external orifice 72 is brought into proximity of the pin 14. Whether a microjunction is formed between the external orifice 72 and the top surface 13 can be controlled based on at least the following factors: (i) the distance between the top surface 13 and the external orifice 72, and (ii) controlling the pressure and flow rate of the liquid 20. In many instances, it will be desirable to contact the liquid 20 with the sample 16 without forming a liquid microjunction or without contacting the distal end of the sampling device against another surface, e.g., a plate. The sampling device 80 can be configured to generate a stream of sampling solution 22 from the sample 16 located on the tip of each pin 14 when the external orifice 72 is brought into proximity with each pin 14.

Where it is desired to insert each pin 14 within the sampling device 80, each pin 14 can have a diameter less than a diameter of the inner capillary tube 60 or twice a semiminor axis of the inner capillary 61, if the inner capillary 61 has an elliptical cross-sectional area. The array of pins 14 can have a regular spacing in a direction, and a maximum lateral dimension at the distal end 82 along the direction that is less than a sum of twice the regular spacing in the direction and the diameter of each pin 14. For example, the regular spacing can be from 200 microns to 10 cm. Typically, each pin within the array of pins has a height from 100 microns to 10 mm.

Where the pins 14 are cylindrical pins, each pin 14 within the array of pins can have a diameter that is from 5 micron to 200 microns. The diameter of the inner capillary 61 or twice the semiminor axis of the inner capillary 61 can be from 50 microns to 400 microns. In case the pins 14 are conical pins, each pin 14 within the array of pins can have a base diameter that is from 1 micron to 1,000 microns or 5 microns to 200 microns. The diameter of the inner capillary 61 or the twice the semiminor axis of the inner capillary 61 can be from 50 microns to 400 microns.

The stepper mechanism 90 can be configured to move the pin assembly 11 relative to the sampling device 80 so that different samples 16 are placed sequentially in proximity to, or through, the external orifice 72. The stepper mechanism 90 can be configured to change the distance between the pin assembly 11 and the external orifice 72, i.e., the distance along the axis perpendicular to the Y1-Y1' plane, and to move the pin assembly 11 in a direction parallel to the top surface 13. Where the pin assembly 11 includes a two-dimensional array of pins 14, the pin assembly 11 can move independently in each of these directions, which will generally be orthogonal to one another.

Typically, the pin assembly 11 can be detached from the stepper mechanism 90 to obtain the samples 16, for example by impalement or exposure to an atmosphere of interest, and can subsequently be coupled to the stepper mechanism 90 by any known coupling technique such as screws, bolts, pins, glue, or a combination thereof. The stepper mechanism 90 can include mechanisms to effect linear movement of the pin assembly 11 along the direction perpendicular to the top surface 13 of the plate 12, i.e., the direction perpendicular to the Y1-Y1' plane, as well as along at least one direction parallel to the top surface 13 of the plate 12, i.e., a plane parallel to the Y1-Y1' plane. The stepper mechanism 90 can include mechanisms to effect linear movement of the pin assembly along at least two directions within a plane parallel to the top surface 13 of the plate 12. The mechanisms for effecting linear movements can include any components known in the art including, but is not limited to, a motor and suitable gears such as a rack and a pinion, a worm gear, a spur gear, a bevel gear, and any other types of gears. Further, the stepper mechanism 90 can include sensors and controls for calibrating and monitoring the movement of the stepper 90 in at least one direction.

In the example of FIG. 3, a plurality of samples 16 can be coupled to the array of pins 14. Specifically, the pin assembly 11 can be employed to impale a specimen, to absorb a chemical, or to adsorb a chemical so that discrete samples 16 are coupled at the tips of the array of pins 14. The pin assembly 11 can then be mounted to the stepper mechanism 90, which moves each sample 16 into contact with the liquid 20 controlled by the sampling device 80 sequentially. Thus, the plurality of samples 16 are used to produce a sequence of testing solutions 22 sequentially.

Figure 3A:
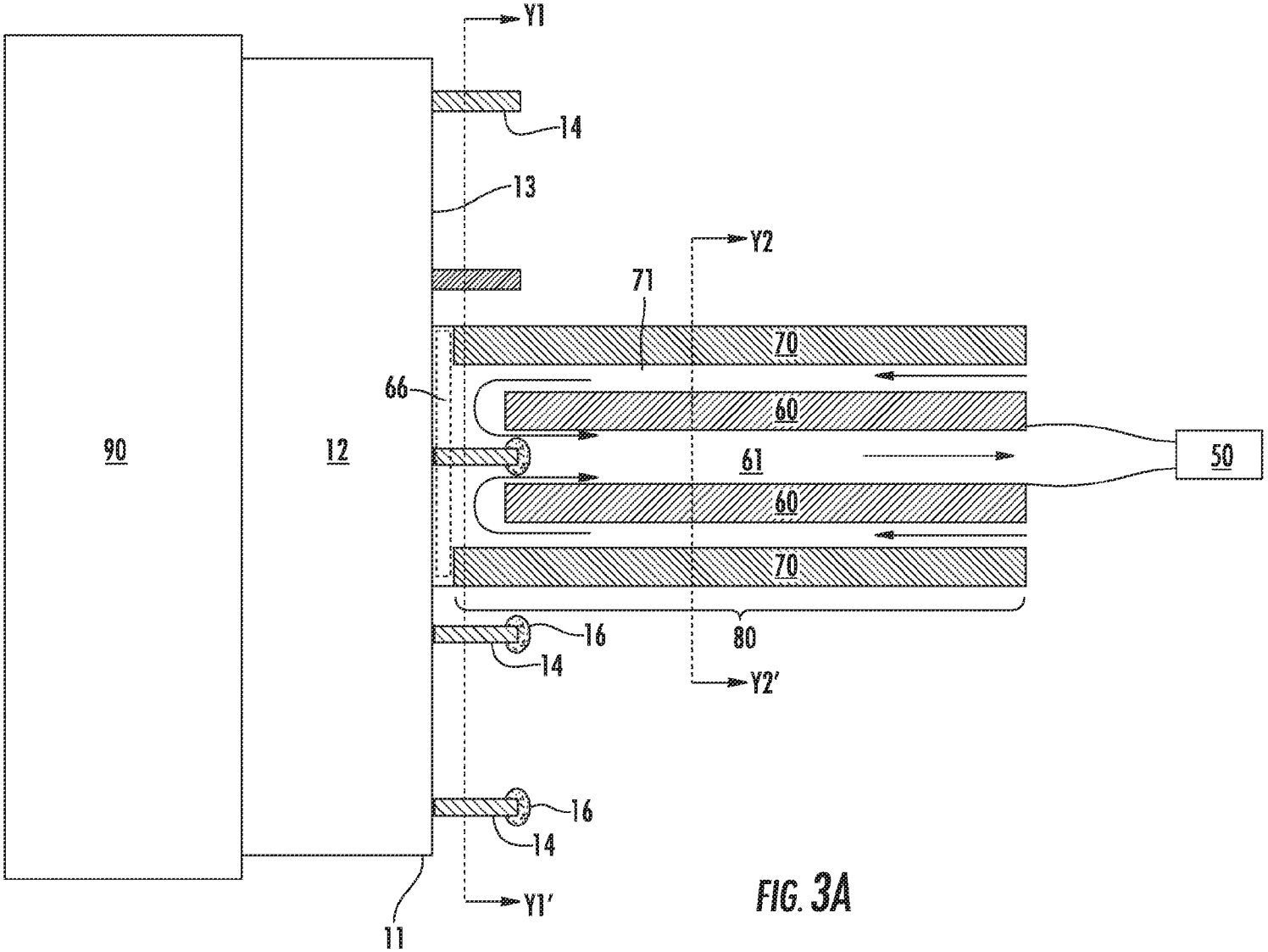
FIG. 3A is a longitudinal cross-section of a dual capillary sampling device and sample coupled to a pin according to the invention taken along cut line X-X' in FIGS. 3B-3D.
Figure 3B:
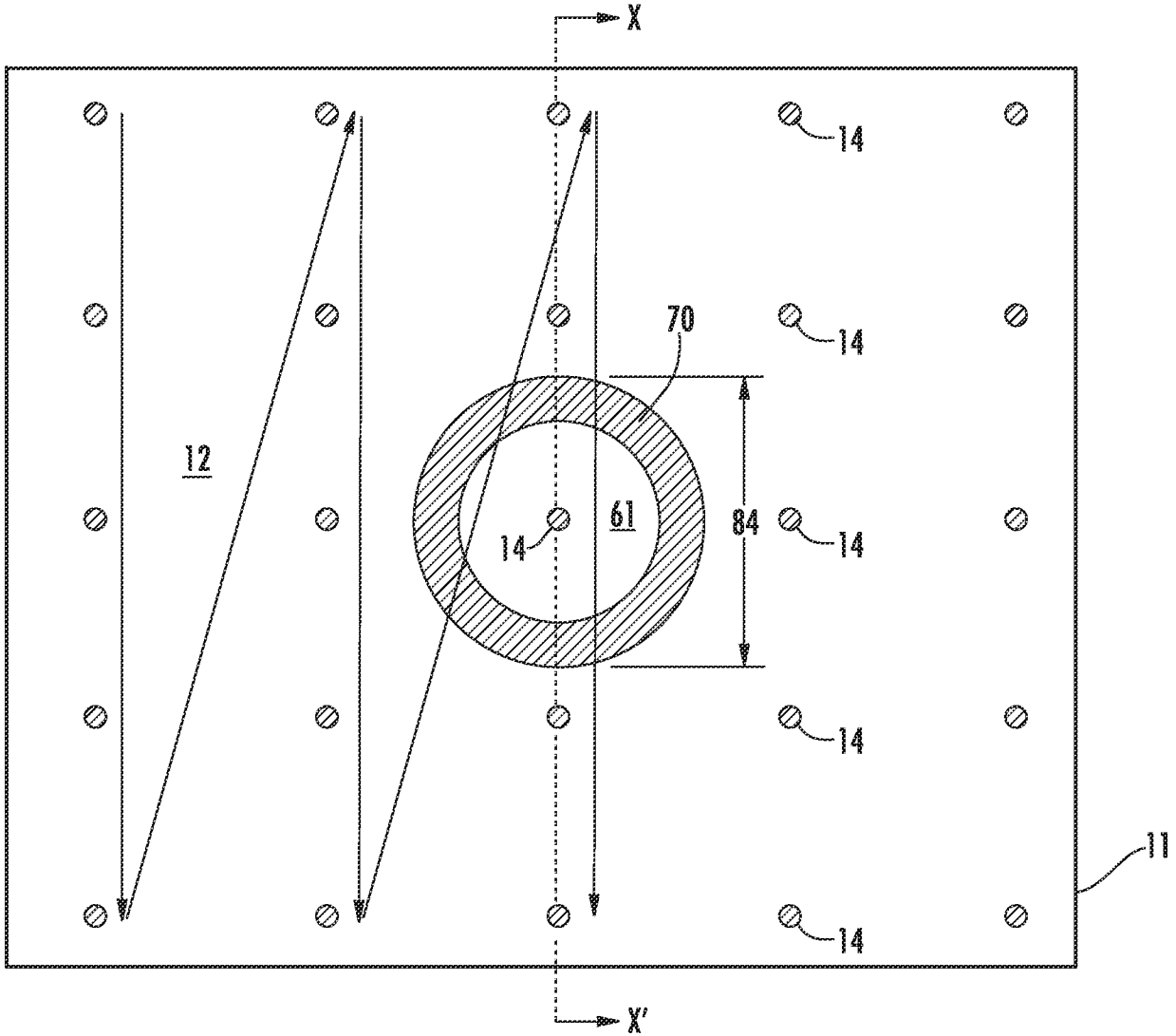
FIG. 3B is a cross-sectional view of the device according to FIG. 3A taken along cut line Y1-Y1'.
Figure 3C:
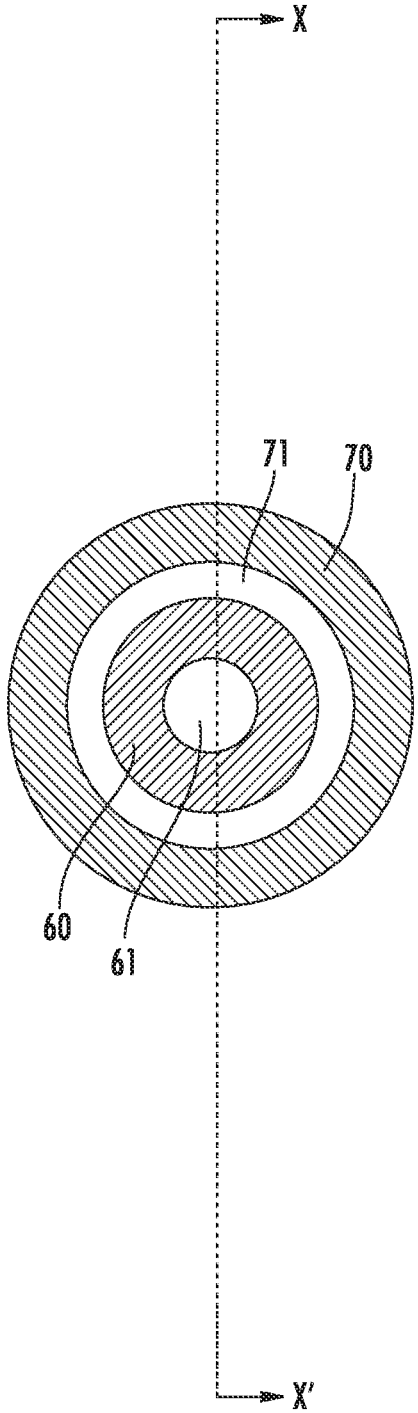
FIG. 3C is a cross-sectional view of the device according to FIG. 3A taken along cut line Y2-Y2'.
Figure 3D:
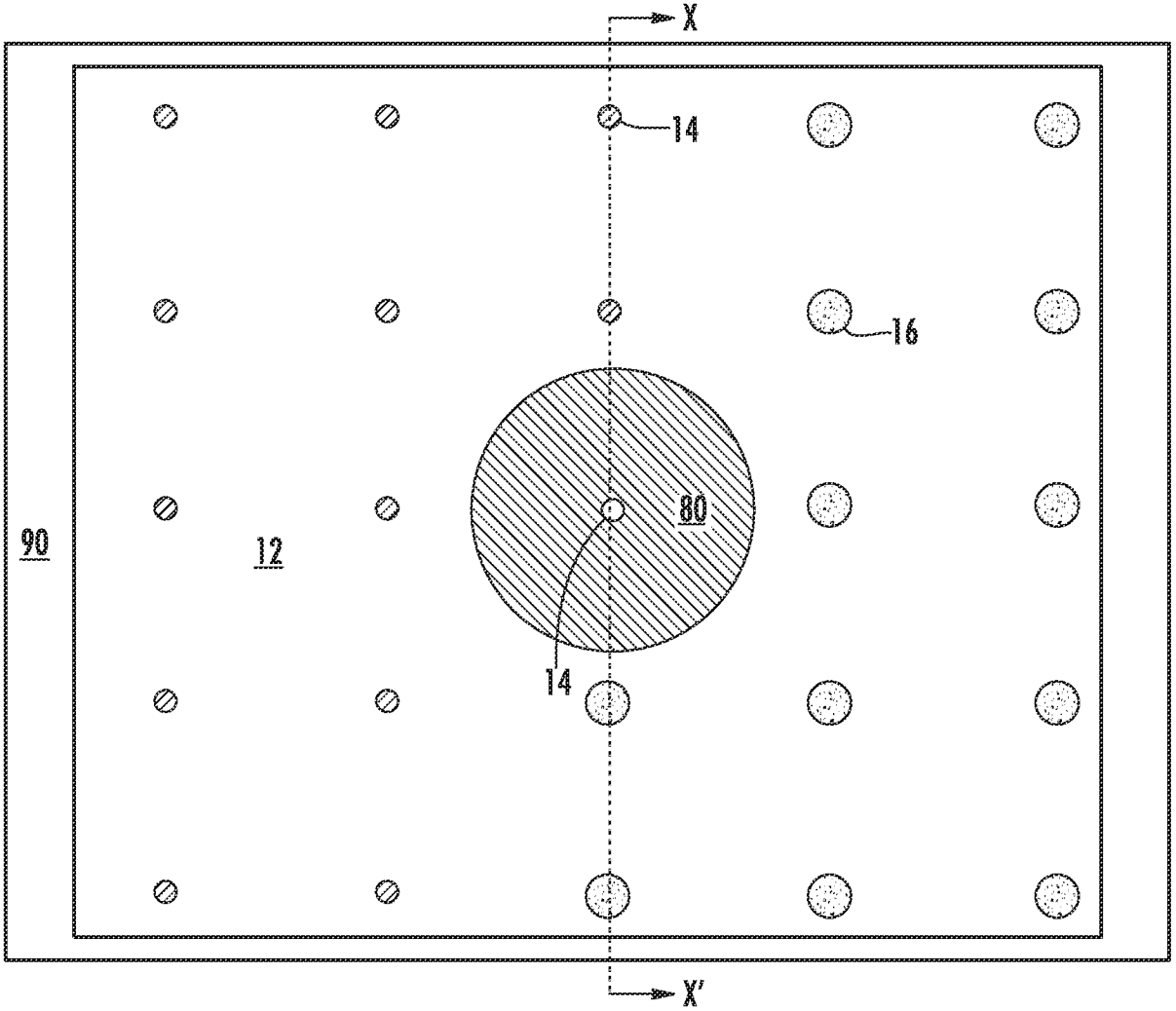
FIG. 3D is a cross-sectional view of the device according to FIG. 3A taken along cut line Y1-Y1'.
Figure 3E:
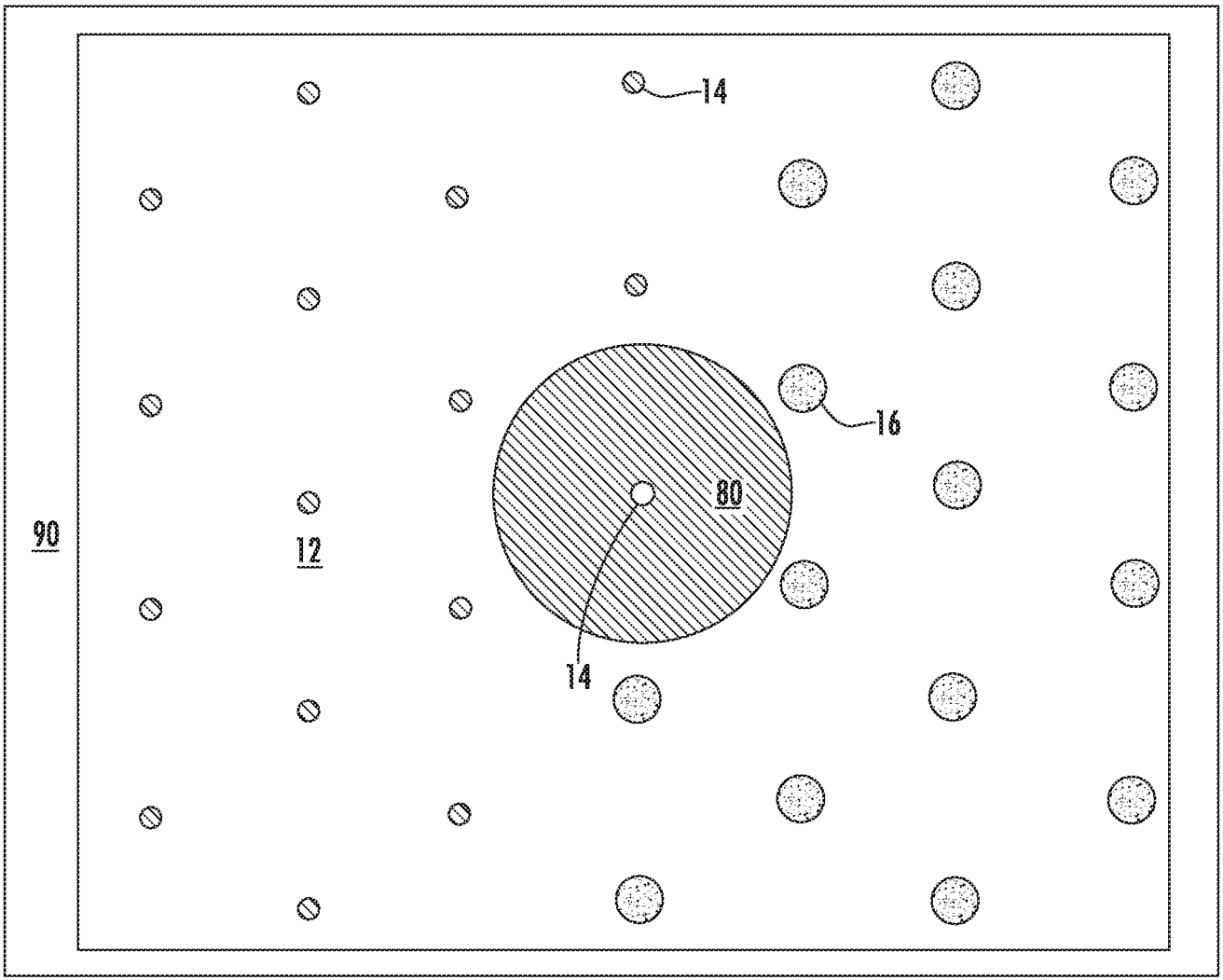
FIG. 3E is a cross-sectional view of the device according to FIG. 3A taken along cut-line Y1-Y1' where the arrangement of the array of pins is varied.
Figure 3F:
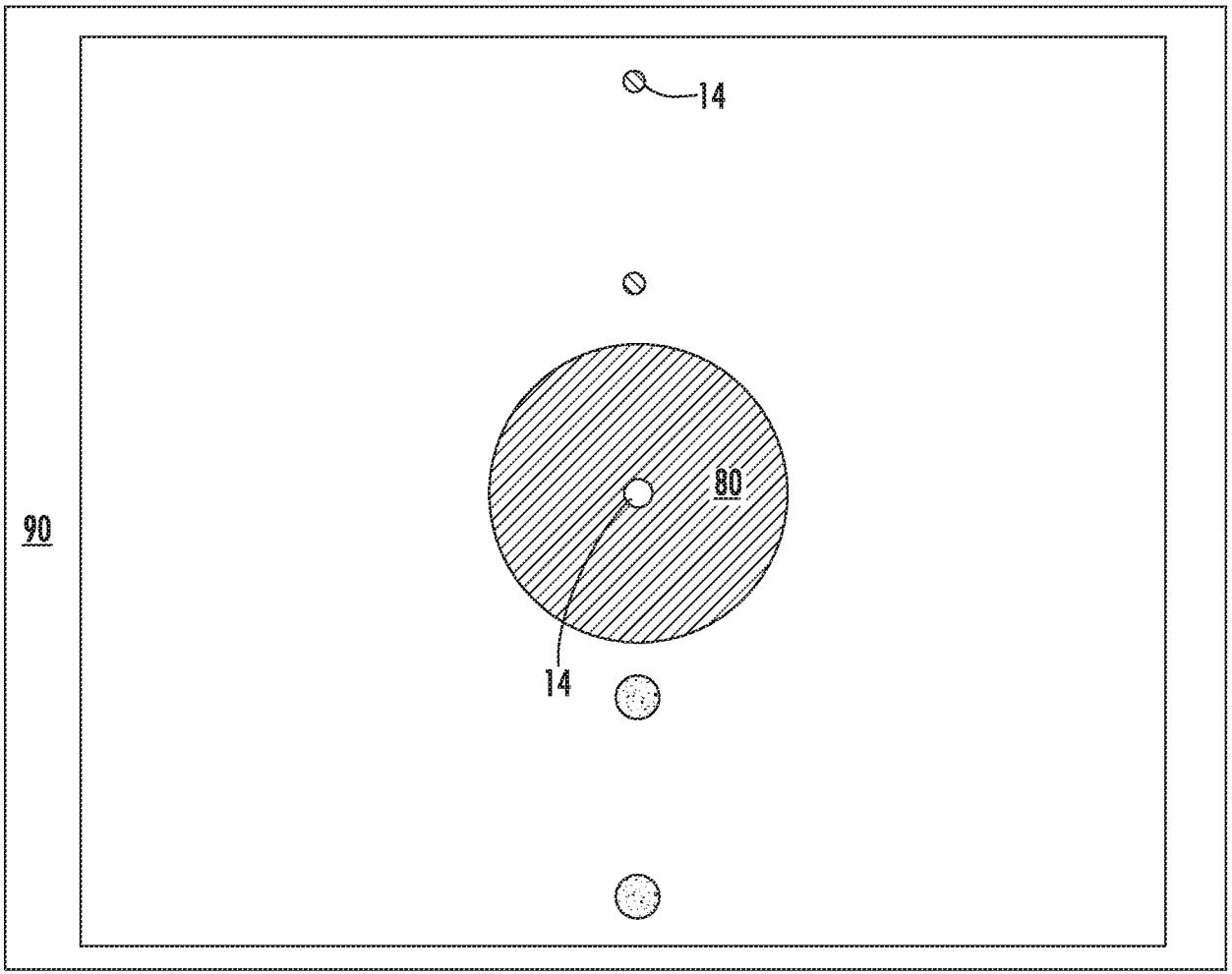
FIG. 3F is a cross-sectional view of the device according to FIG. 3A taken along cut-line Y1-Y1' where the arrangement of the array of pins is varied.

As shown in FIG. 3A, the liquid 20 can be supplied through the outer capillary 71, brought into contact with the sample 16 at the external orifice 72, and then transported through the inner capillary 61 as a testing solution 22. The sampling device 80 can produce a stream of testing solution 22 from each sample 16 when each sample 16 is dissolved in the liquid 20 to form the testing solution 22. Typically, the liquid 20 is a solvent that is capable of dissolving the material of the sample 16. For example, the liquid 12 can be water, alcohol, or any other solvent known to dissolve the material of the selected sample 16. As shown in FIG. 3A, the stream of testing solution 22 can be generated while maintaining a liquid micro-junction interface 66 between the external orifice 72 and the top surface 13 of the plate 12. The liquid 20 becomes the testing solution 22 as the sample 16 dissolves in the liquid 20.

The testing solution 22 stream can be in fluid communication with an analytical device 50. For example, the testing solution 22 can be in fluid communication with an electrospray ionization source 52. The testing solution 22 can be in fluid communication with the electrospray ionization source either continuously or intermittently.

Each sample 16 can be analyzed sequentially as illustrated by the schematic scanning pattern shown in FIG. 3B. The data can be complied to form a two-dimensional map, or surface, of the composition of the specimen from which the array of samples 16 was obtained. The resolution of the two-dimensional map, i.e., the pixel size of the two-dimensional map, is determined by the spacing of the pins along each direction of periodicity during the sampling step. Because the spacing of the pins 14 may be adjusted after the pins 14 are contacted with the specimen, the resolution is not limited by the size of the sampling device 80.

Referring to FIG. 3E, the pin assembly 11 can employ a hexagonal array as a two-dimensional array for the pins 14. The hexagonal array can have a regular spacing along three lines that are separated by 60 degrees from one another.

Figure 4:
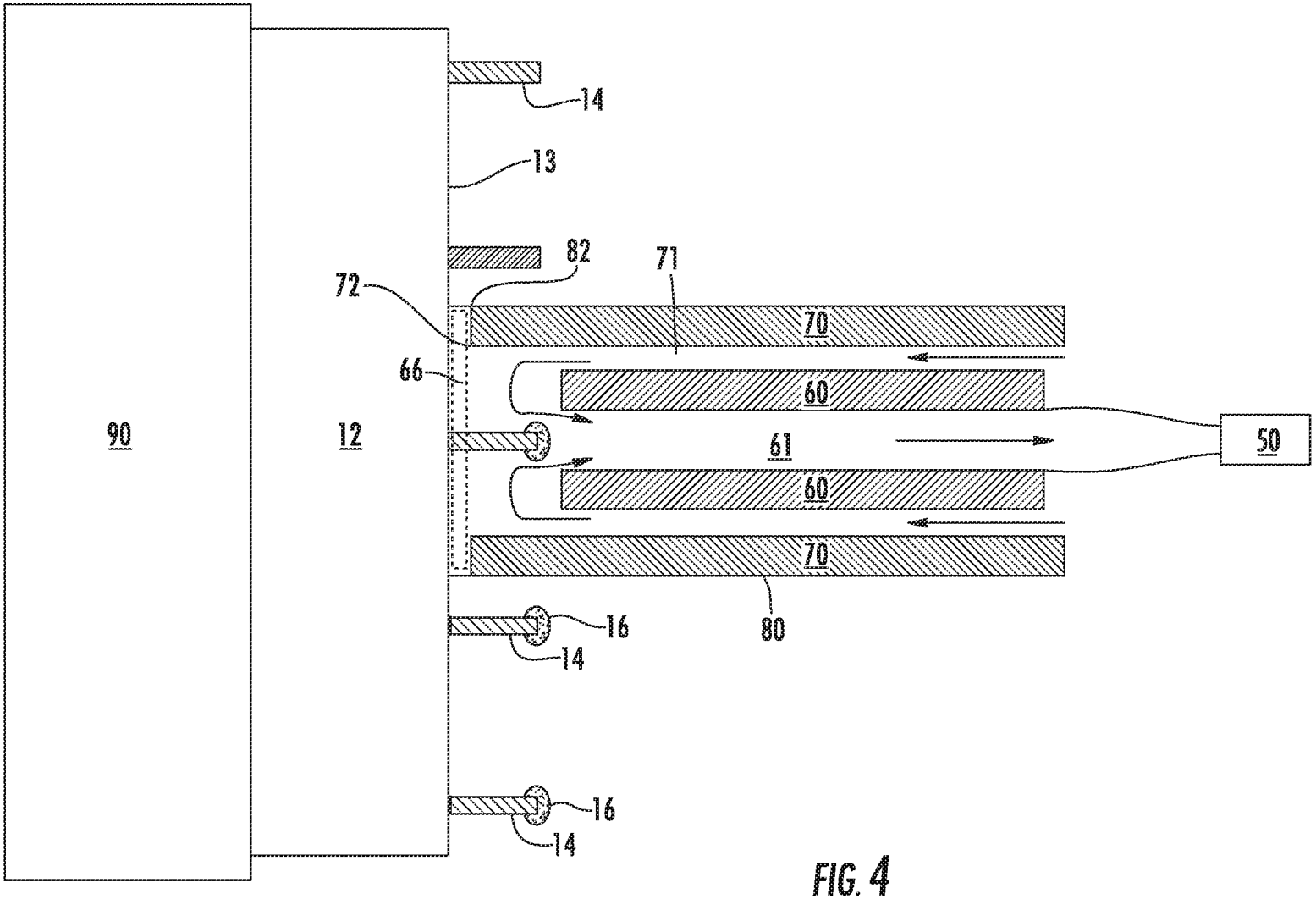
FIG. 4 is a longitudinal cross-section of a variation of the dual capillary device according to the invention where the inner capillary is recessed such that the pin does not extend into the inner capillary.

FIG. 4 shows a variation of the system 10 of FIG. 3, where the height of each pin 14 is less than the distance between the top surface 13 of the plate 12 and a distal end of the inner tube 60 of the liquid extraction surface sampling probe when a liquid junction is formed between the external orifice 72 and the top surface 13. Thus, during the contacting step, the sample 16 under analysis is not within the inner capillary 61, but is located within the capillary tube 70. The modification can be effected by shortening the pins 14 or by recessing the inner tube 60 relative to the outer tube 70.

Figure 5:
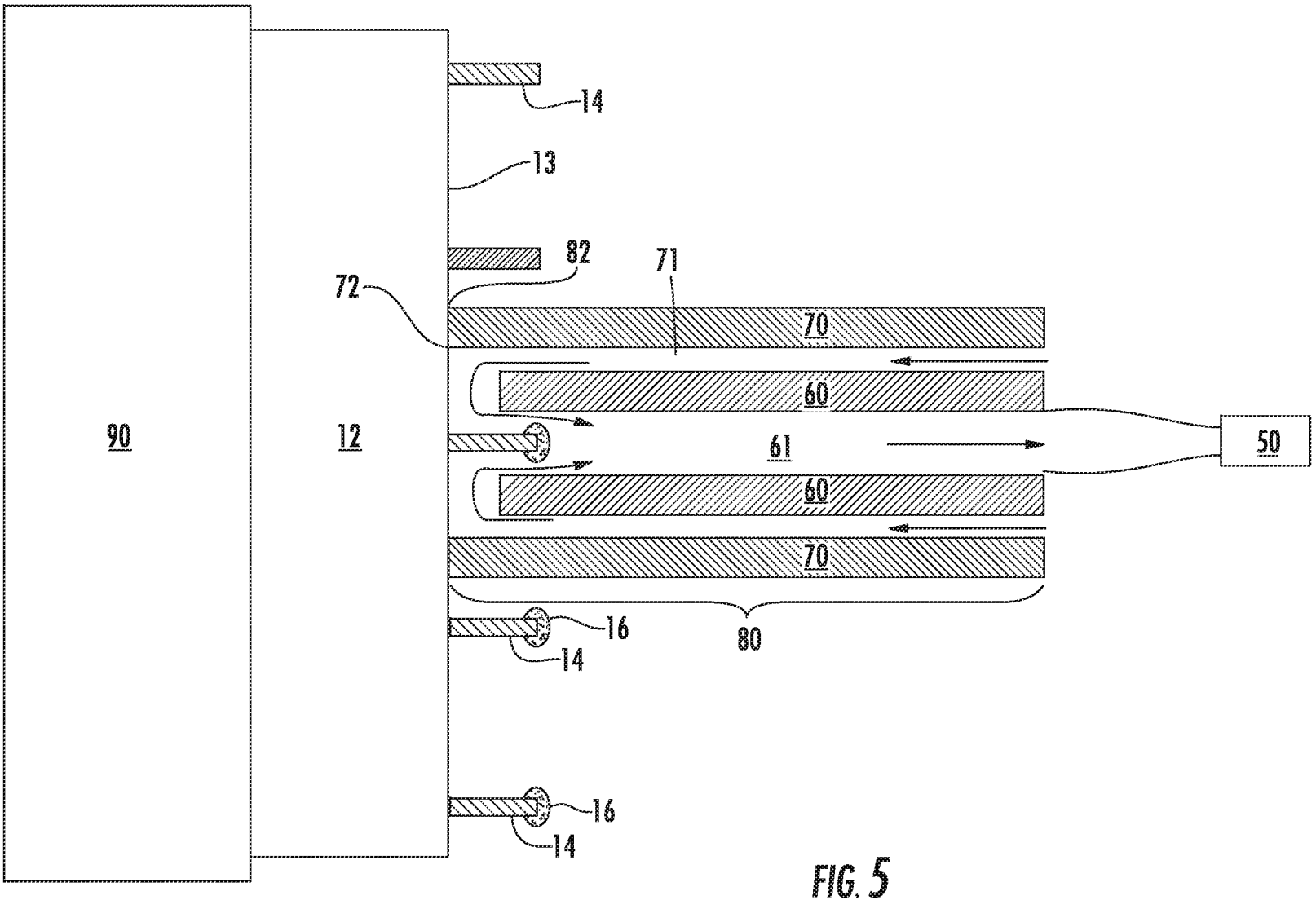
FIG. 5 is a longitudinal cross-section of a variation of the dual capillary device according to the invention where the outer capillary seals against the plate.

FIG. 5 shows a variation of the methods shown in FIGS. 3A & 4, where the exterior orifice 72 contacts the top surface 13 of the plate 12 during the operation. Thus, there is no meniscus present in the embodiment of FIG. 5. The sample 16 under analysis can be inserted within the inner capillary 61 or can be located within the capillary tube 70. In the variation of FIG. 5, the sampling device 80 can be a sealing surface sampling probe configured to provide the testing solution 22 stream while contacting the top surface 13 of the plate 12. The seal may be provided by a surface-to-surface contact, or a knife edge (not shown) provided on the distal end 82 of the sampling device 80 to contact the top surface 13 of the plate 12.

Figure 6:
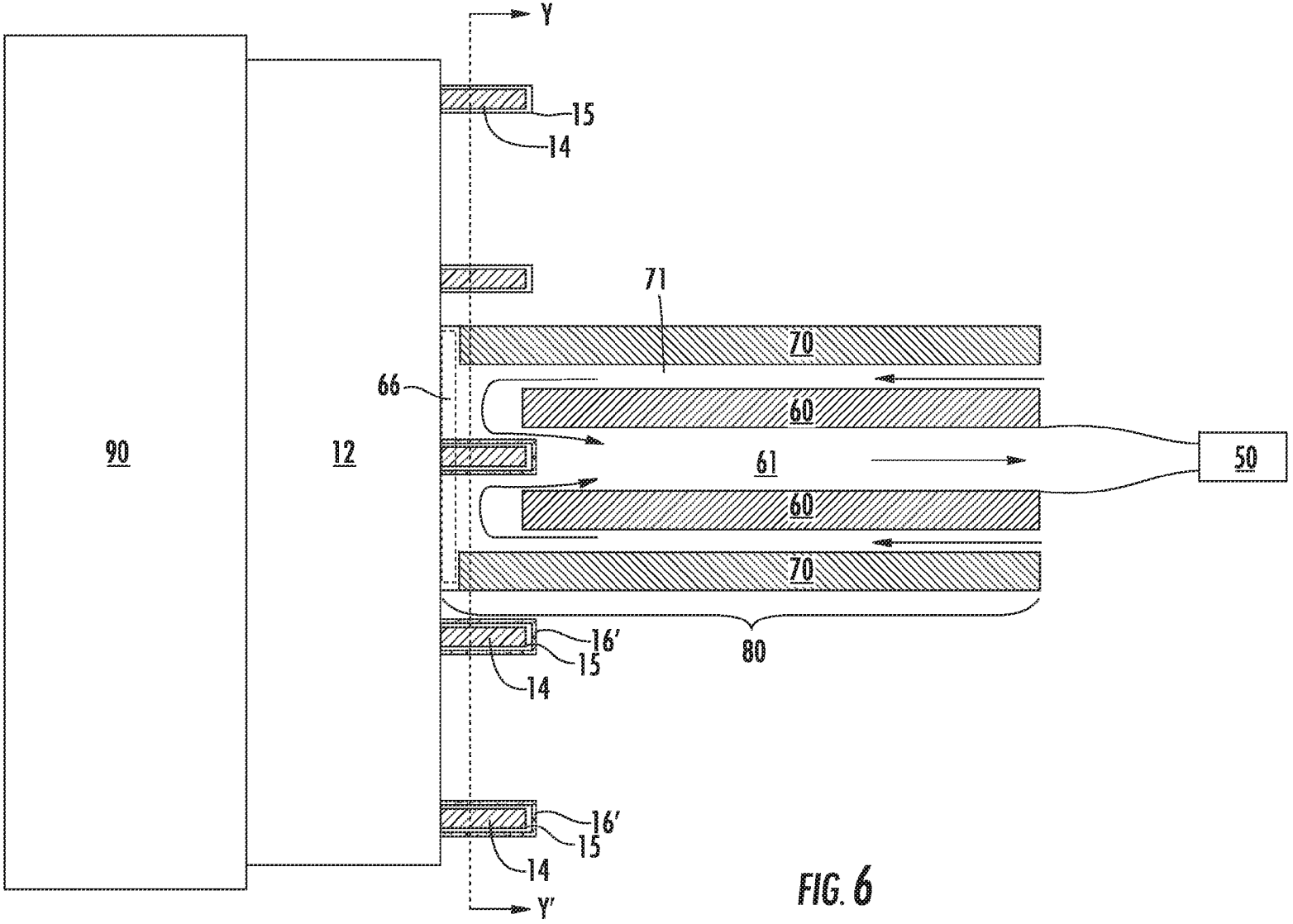
FIG. 6 is a longitudinal cross-section of a dual capillary sampling device and a sample coupled to a pin via a solid phase microextraction coating according to the invention.

FIG. 6 shows an embodiment where the at least one pin 14 within the array of pins has a solid phase microextraction (SPME) coating layer 15 disposed thereon. Each pin 14 of the array of pins can be coated with a solid phase microextraction (SPME) coating layer 15 and used to analyze the results of a solid phase microextraction. Solid phase microextraction is a solventless sample preparation technique that uses a polymer-coated fiber to concentrate volatile and semi-volatile organic compounds. SPME does not employ any solvent or complicated extraction apparatus during the sample acquisition phase. In this embodiment, the pins 14 are coated with an extracting phase material 15, which can be a liquid (polymer) or a solid (sorbent), designed to extract a volatile and/or non-volatile analytes from different kinds of media in a fluid phase. After the microextraction, the coating layer 15 on the pins 14 will be coated with a sample 16'. The samples 16' on each of the pins can then be sequentially dissolved in the liquid 20 to form a testing solution 22 just as in the other examples described herein.

Figure 7:
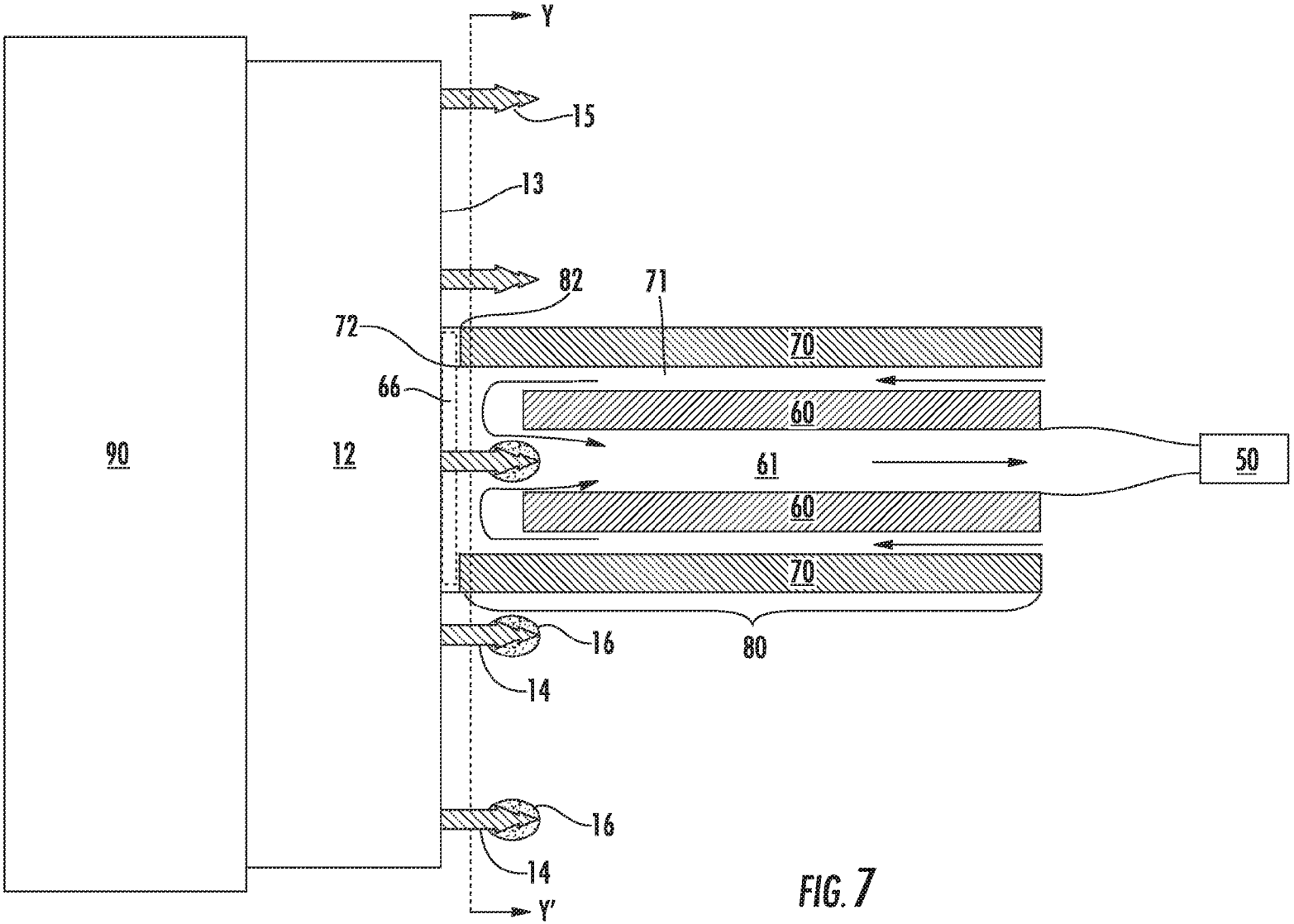
FIG. 7 is a longitudinal cross-section of a dual capillary sampling device and a sample coupled to a pin having a dual tapered tip according to the invention.

FIG. 7 shows an example where the pins 14 include a double taper. The cross-sectional area of each tip of the pins 14 decreases toward the distal end of the pin 14. The tip can have a conical structure, or, as shown in FIG. 7, may include a plurality of conical, frustum-shaped, or other similar structures. The taper(s) in the tip of a pin 14 can be employed to enhance adhesion or attachment of the sample 16 during the contacting phase. Once the samples 16 are attached to the tips of the pins 14, the samples 16 can be sequentially dissolved using the sampling device 80 in one of the configuration described herein.

Figure 8:
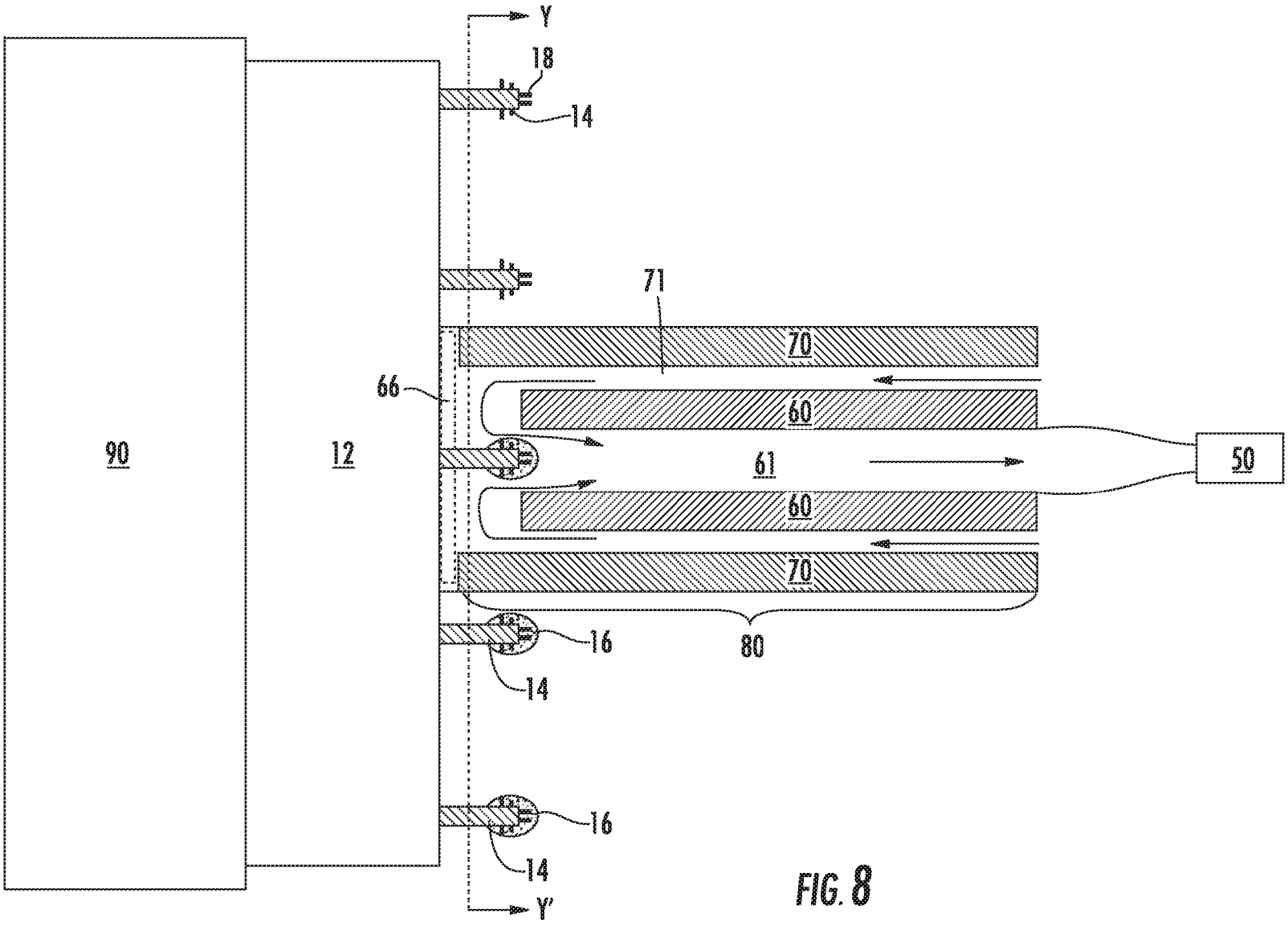
FIG. 8 is a longitudinal cross-section of a dual capillary sampling device and a sample coupled to a pin having protruding prongs according to the invention.
Figure 9:
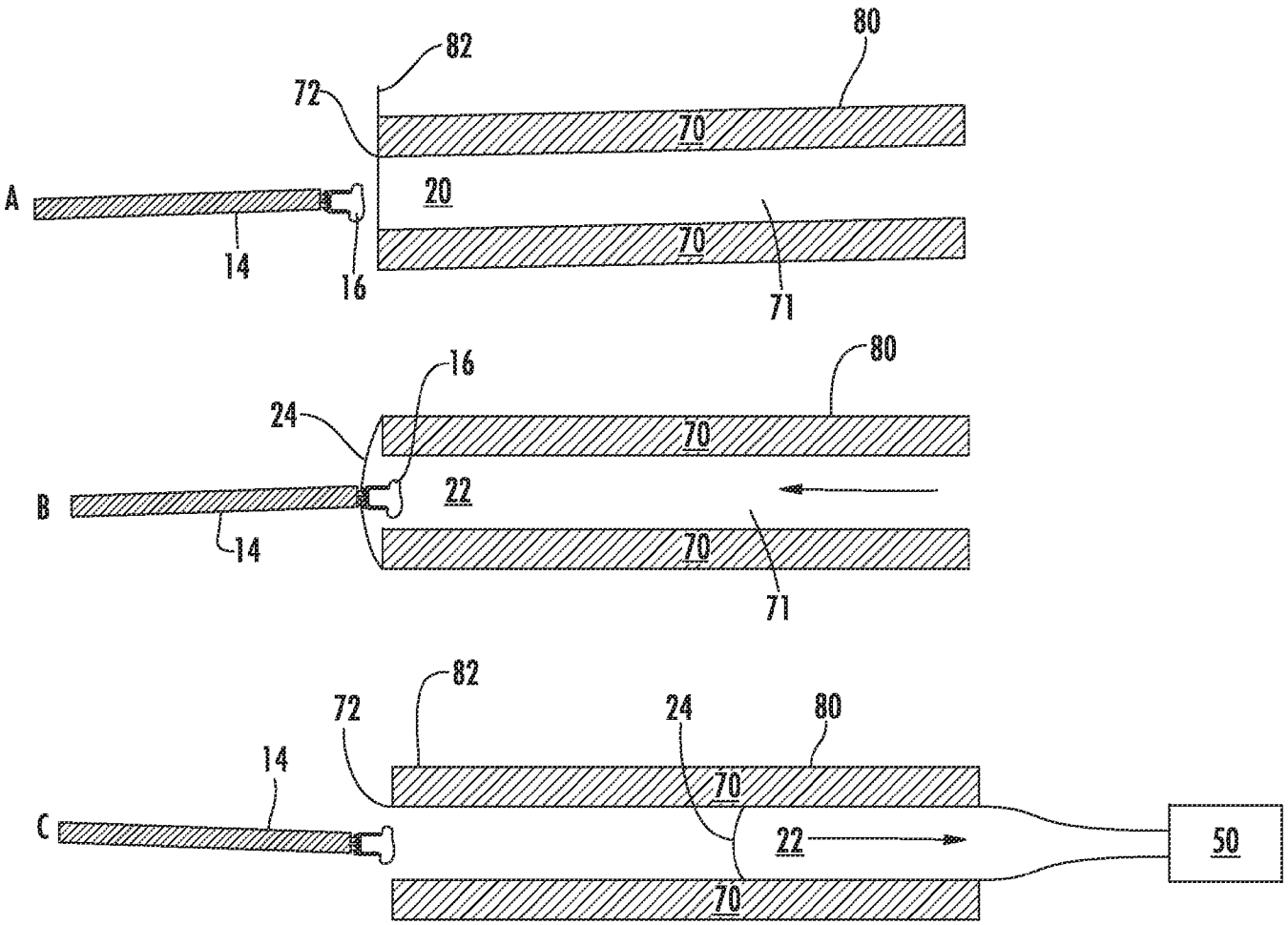
FIG. 9A-C is a longitudinal cross-section of a dual capillary sampling device and a sample coupled to a pin having a punch tip according to the invention.

FIG. 8 shows an example where the pins 14 within the array include at least one protruding prong 18. Each protruding prong 18 may extend along the same direction as a lengthwise direction of the at least one pin 14, or along a direction different from the lengthwise direction of the at least one pin 14. If the main portion of the pin 14 is cylindrical, the diameter of each protruding prong 18 can be less than the diameter of the main portion of the pin 14 from which the protruding prong 18 extends. The protruding prongs 18 can be employed to enhance coupling of the sample 16 to the pin 14 during sampling, for example, by impalement into a biological sample. Once the samples 16 are attached to the tips of the pins 14, the samples 16 can be sequentially dissolved using the sampling device 80 in one of the configuration described herein.

FIG. 9 is a single capillary embodiment similar to FIG. 1. The primary difference is that FIG. 9 shows an embodiment where the tip of the pins 14 includes a punch structure for retaining a sample 16 from a specimen. For example, where the specimen is tissue, a punch may be useful to extracting a portion of tissue, much as is done for some biopsy procedures. Although FIGS. 5-9 show specific combinations of pin 14 shape/chemistry and sampling device 80 design, it should be understood that any of the pins 14 described herein can be used with any of the sampling devices 80 disclosed herein.

Figure 10A:
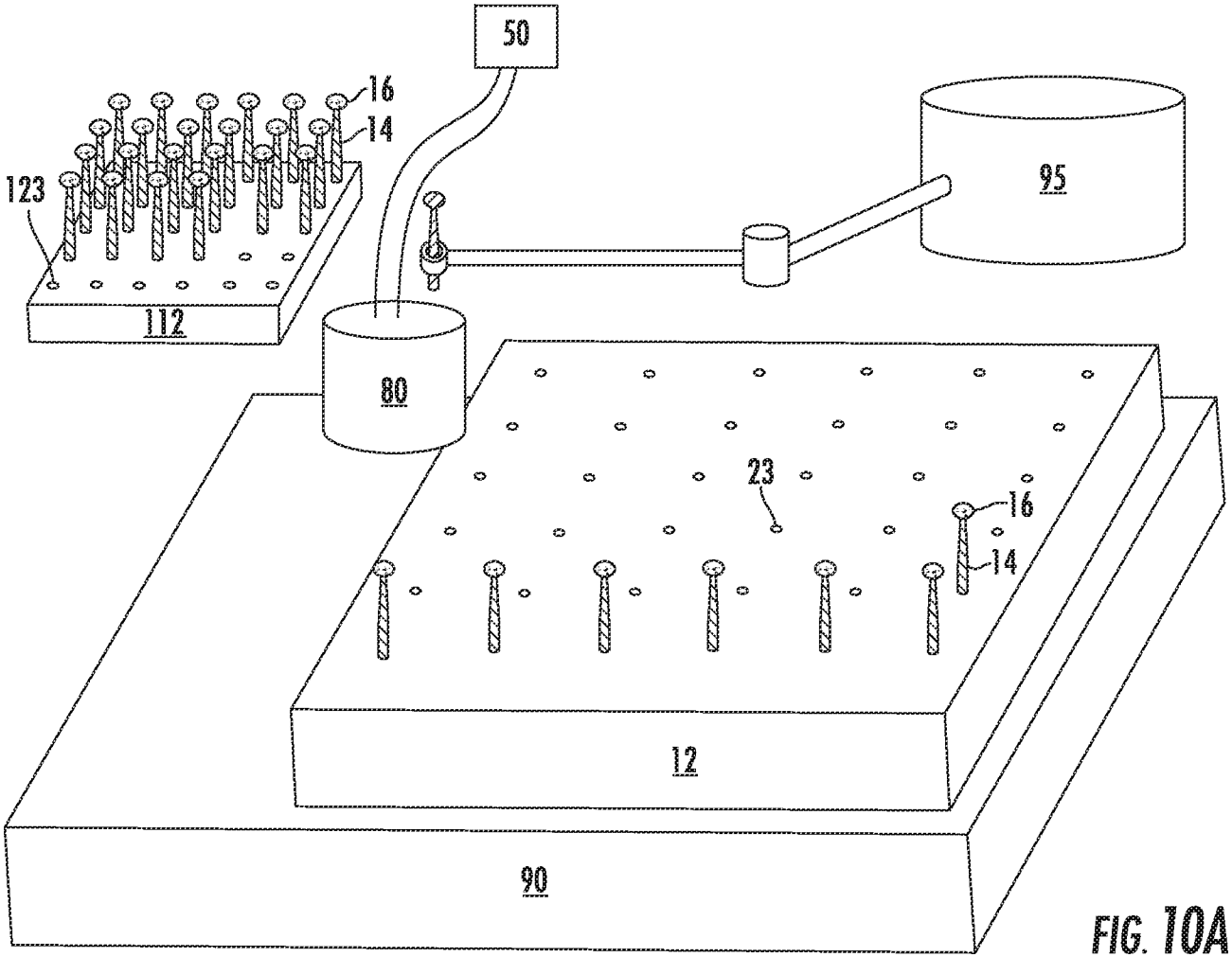
FIG. 10A is a perspective view of an embodiment of the invention where one or more pins are transferred from an impalement plate to a sampling plate prior to analysis of the sample on each pin.
Figure 10B:
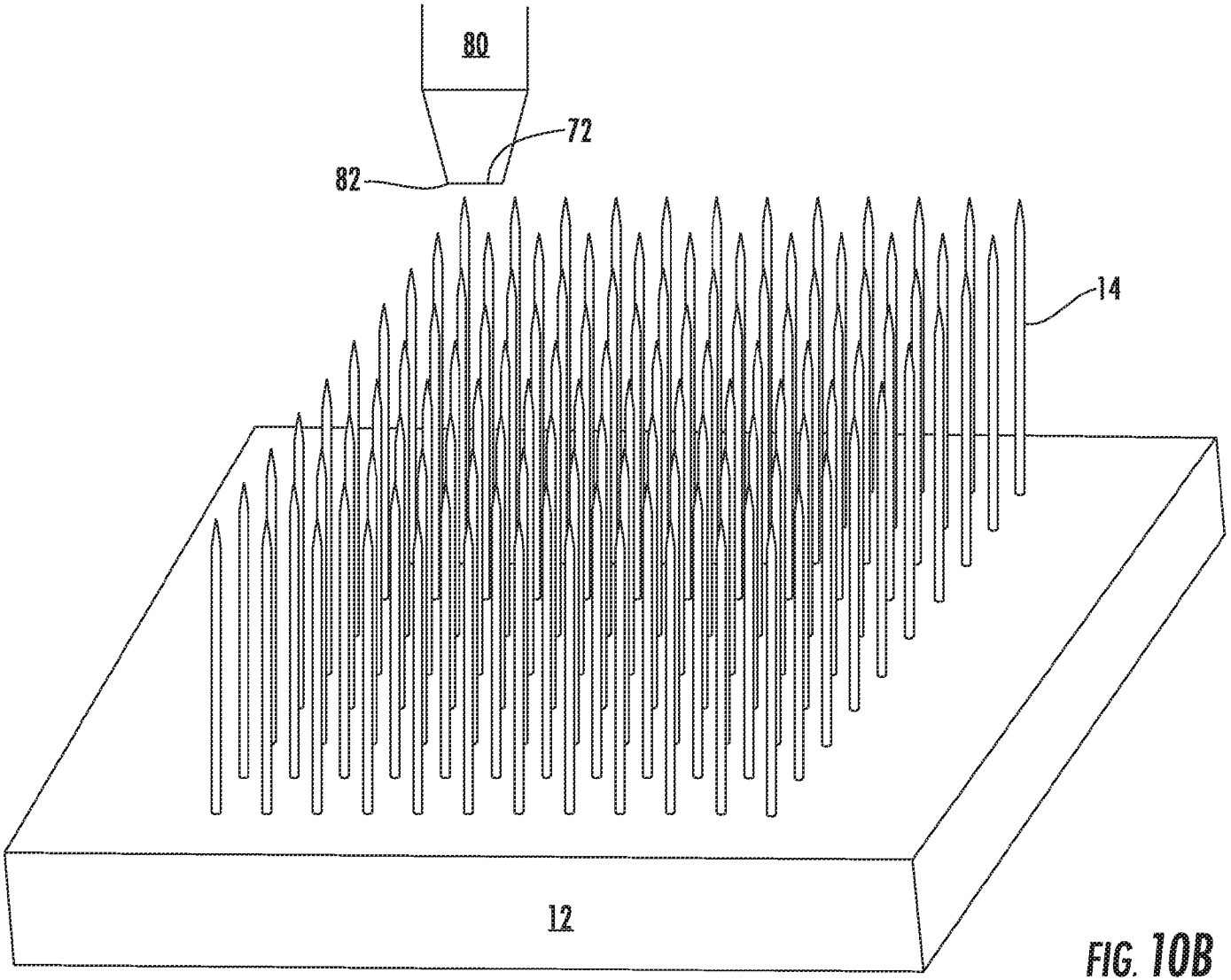
FIG. 10B is a perspective view of a sampling plate after the pins have been transferred from the impalement plate.
Figure 17:
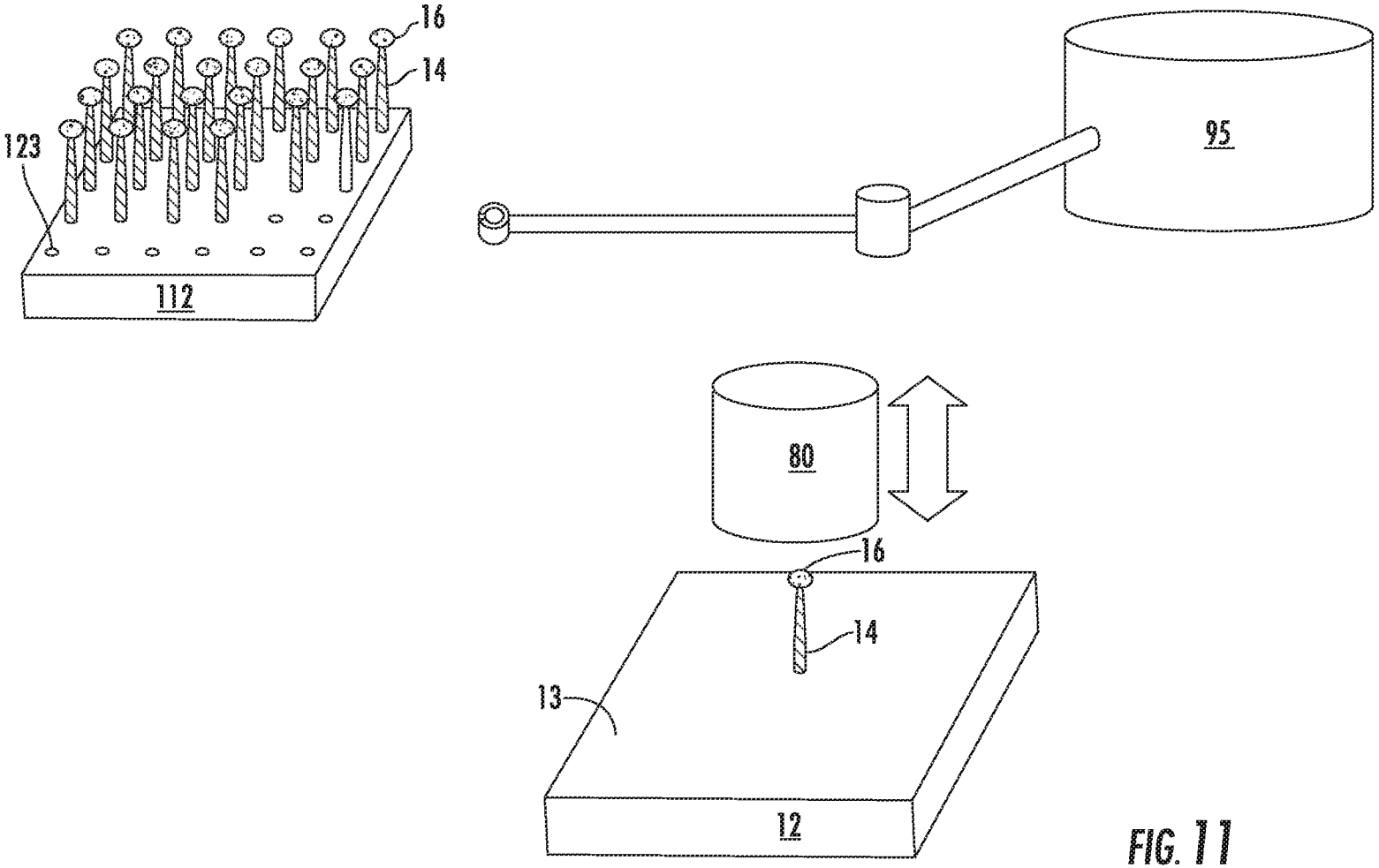

FIGS. 10A and 10B show an embodiment where the positioning of the pins 14 is adjusted after the samples 16 are coupled to the tips of the pins 14. As shown in FIG. 10A, the system can include a plate 12 and an array of pins 14 located within holes 23 on a top surface of the plate 12. Each pin 14 can be inserted into a hole 23 by a robotic arm 95, and can be removed from the hole 23 by the robotic arm 95. Further, an impalement plate 112 having an array of holes, which are herein referred to as impalement plate holes 123, can be provided to hold the pins 14 when the pins 14 are contacted with the specimen.

In order to provide an array of samples 16, the impalement plate holes 123 are filled with pins 14 to form an array of pins. Each pin 14 in the array of pins fitted within the impalement plate holes 123 can be a pin according to any of the embodiments of the present invention as described above. The spacing between the pins 14 placed within the impalement plate holes 123 in the impalement plate 112 can be less than, the same as, or greater than, a diameter of a bottom portion of a pin 14. Once the pins 14 form an array in the impalement plate 112, the pins 14 can impale a target area in a solid phase to form samples 16, which become attached to the pins 14 after impalement. Alternately, the pins 14 can be exposed to a fluid or any other exposure designed to detect presence of a material with an areal resolution corresponding to the pitch of the pins 14 as located in the impalement plate 112.

Once an array of samples 16 is coupled to the array of pins 14 in the impalement plate 112, each pin 14 can then be transferred out of an impalement plate hole 123 into a hole 23 within the plate 12. The transfer of the assembly of the pin 14 and the sample 16 can be performed by the robotic arm 95. Alternately, the transfer can be performed manually or through some alternative automated technique. The plate 12 can be located on a stepper 90, which can move the plate 12 in a single direction or within a horizontal plane. The spacing between the holes 23 in the plate 12 can be set to accommodate the dimensions of a distal end 82 of the sampling device 80. Once one or more of the pins 14 have been transferred to the plate 12, the sample 16 can be dissolved and analyzed as described herein. FIG. 10B, shows a plate 12 where all of the pins 14 have been transferred to the plate 12.

Figure 2:
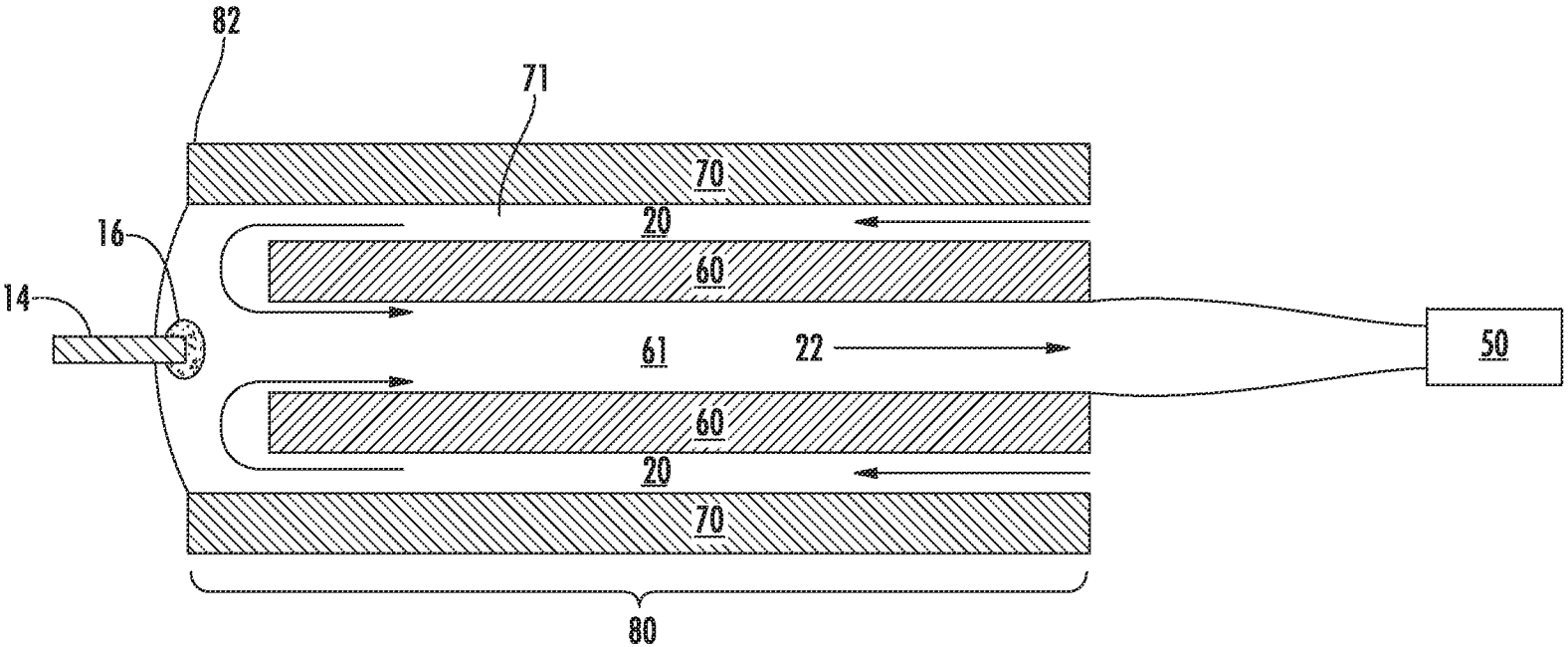
FIG. 2 is a longitudinal cross-section of a dual capillary sampling device and sample according to the invention.

In each of the embodiments described herein, it is possible that the sample 16 would be analyzed without being transferred onto a plate 12. For example, the robotic arm 95 could hold the pin 14 while the sample 16 is dissolved by a liquid 20 in the sampling device 80 in order to produce the testing solution 22 for analysis. With the exception that the robot arm holding the base portion of the pin 14, FIGS. 1, 2 and 9 show the dissolving step of this embodiment.

FIG. 11 shows an embodiment using an impalement plate 112 where a single pin 14 from the impalement plate 112 is removed and analyzed at a time. The plate 12 includes a hole through the top surface 13. A pin 14 with a sample 16 coupled thereto can be coupled to the plate 12 for analysis of the sample 16 by a sampling probe 80. The sampling probe 80 can be configured to mover vertically, for example, by the stepper 90, to bring the sampling device 80 into position to dissolve the sample 16 and subsequently to move the sampling probe out of the way while the pins are moved to and from the plate 12.

Once the samples 16 have been coupled to the array of pins 14, each sample 16 can be analyzed individually by transporting the pin assembly 11 with the samples 16 coupled thereto by robotic arm 95 or manual means. Once the analysis of each sample 16 is complete, the pins 14 can be discarded or placed in an empty impalement plate hole 123.

FIG. 12 shows a compact array of pins 14 located on a vertical-stepping enabled plate 212 and a sampling probe 80. The vertical-stepping enabled plate 212 includes vertical grooves in a compact array such that the spacing between the vertical grooves is minimal. The pins 14 can be placed within the vertical grooves so that a pin 14 laterally contacts other pins 14 within the compact array. The stepper 90 can be coupled to each pin 14 in a manner such that a single pin 14 can be lifted up at a time. For example, the stepper could include a plurality of push pins with a plurality of lifts, where each lift is dedicated to a different pin.

In order to provide an array of samples on the compact array of the pins 14, all of the pins 14 are placed in a starting position, i.e., a position not lifted up, so that the tips of the pins 14 form a starting surface. The pins 14 can impale a target area in a specimen such that samples 16 become coupled to the pins 14 during impalement. Alternately, the pins 14 can be exposed to a fluid or any other exposure designed to detect presence of a material with an areal resolution corresponding to the pitch of the pins 14 in the compact array, which is the same as the diameter of a pin 14.

Once the array of samples 16 is formed, each sample 16 can be analyzed one by one by lifting individual pin 14 sequentially above the surface formed by the tips of the pins 14. Once the sample 16 is dissolved, the pins 14 can be returned to their original position, discarded or placed in an empty impalement plate hole 123. The vertical-stepping enabled plate 212 lifts one pin 14 at a time so that one sample 16 is lifted up to be dissolved by the sampling probe 80. A horizontal stepping mechanism may be provided along with the sampling probe or the vertical-stepping enabled plate 212.

FIGS. 13A-13E show an embodiment where the sample probe 80 is connected to a stepper 90 configured to fill a single capillary 70 sampling probe 80 with a liquid 20; contact the liquid 20 with a sample 16 to form a testing solution 22; and then dispense the testing solution 22 to an analytical instrument 50. Samples 16 in a plurality of pin assemblies (12, 14; 112, 14; or 212, 14) can be analyzed sequentially. Each sample 16 is coupled to a pin 14, which can have any of the geometries described above. Each pin assembly (12, 14; 112, 14; or 212, 14) can have any of the configurations described herein.

Figure 13A:
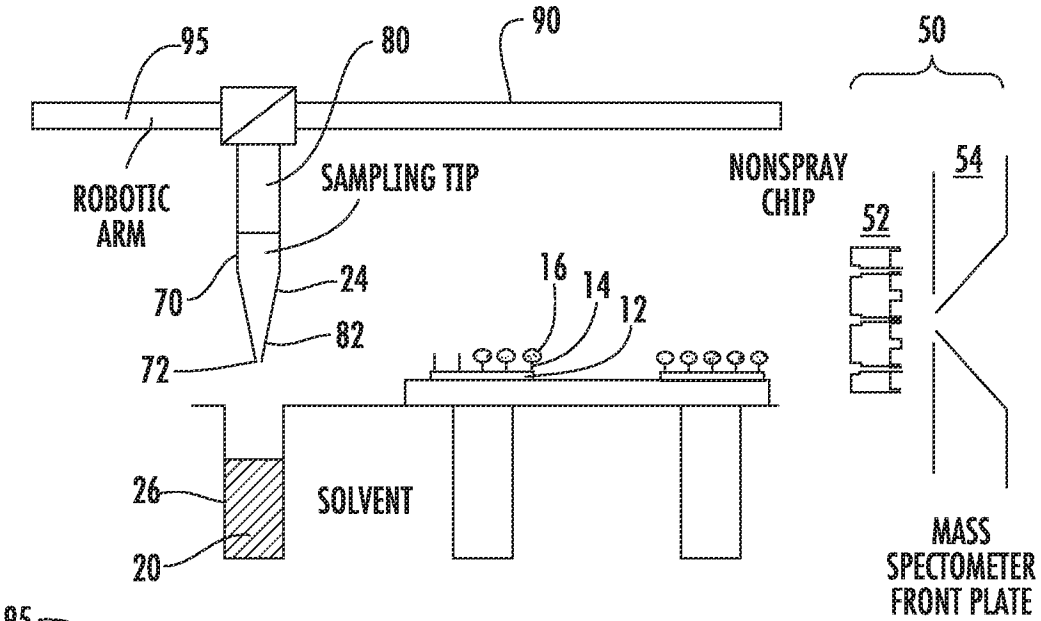
FIGS. 13A-13E are schematic side views according to the invention showing a method according to the invention where samples are sampled sequentially using separate liquid and a separate electrospray ionization plate for each sample.
Figure 13B:
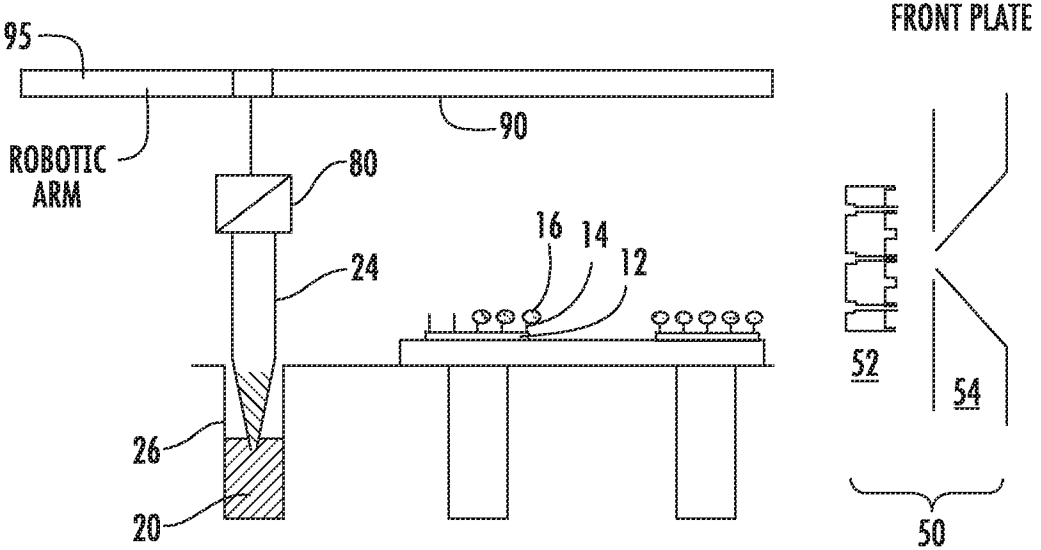
Figure 13C:
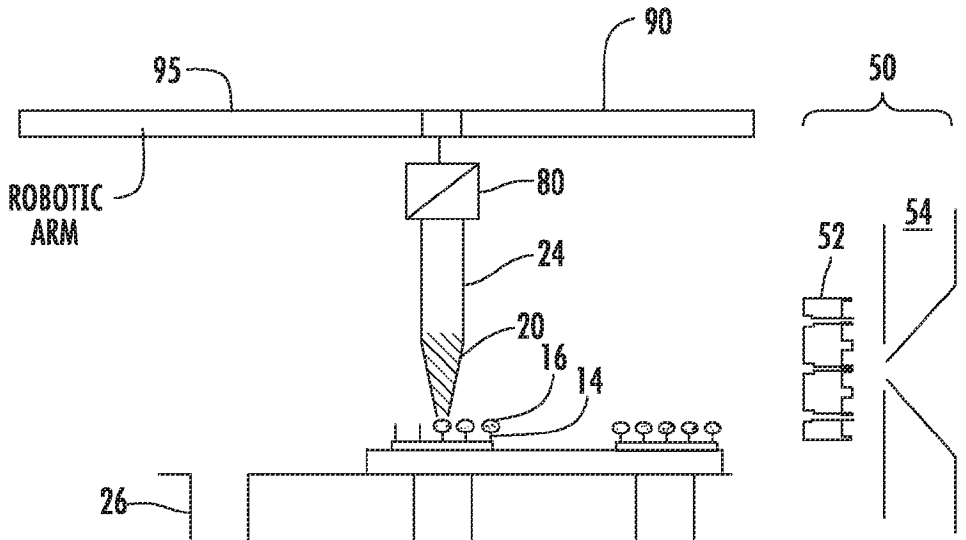
Figure 13D:
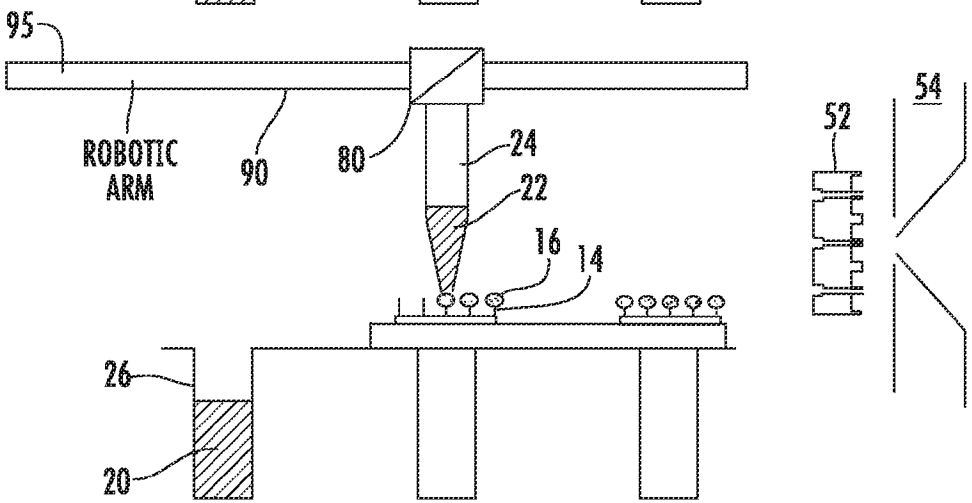
Figure 13E:
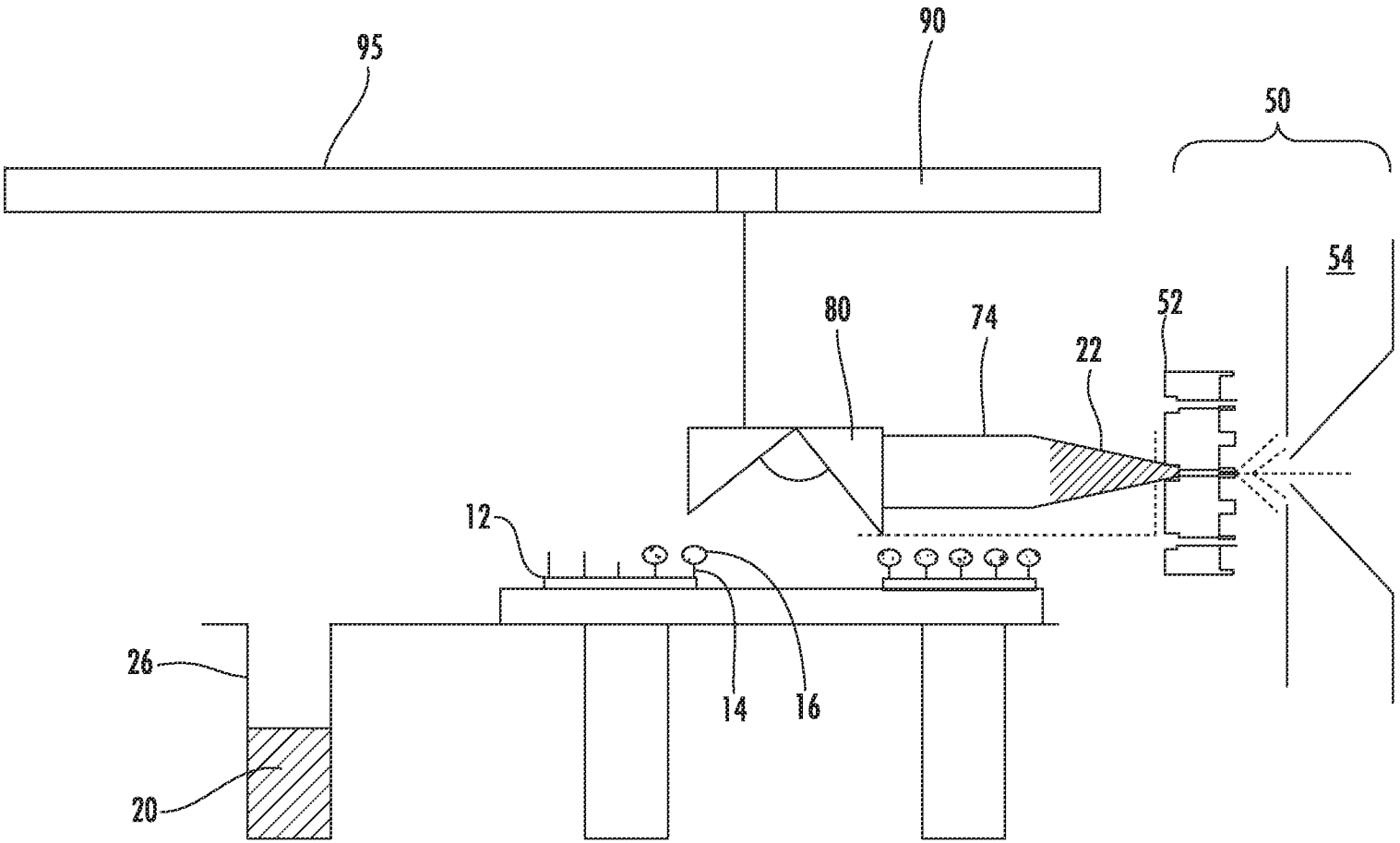

As shown in FIGS. 13A-13E, the sampling probe 80 can include a capillary tube 70 and external orifice 72, which can be disposable, e.g., a pipette tip 74, and the sampling probe 80 can be coupled to a robotic arm 85. The robotic arm 85 can position the sampling device 80 so that it couples with a pipette tip 74. The robotic arm can then move the sampling device 80 above a solvent reservoir 26 (FIG. 13A) and then into the solvent reservoir 26 to aspirate a desired volume of liquid 20 into the pipette tip 74 (FIG. 13B). The robotic arm 74 can then move the sampling device 80 so that the liquid 20 is contacted with the sample 16 (FIG. 13C) in order to form the testing solution 22 (FIG. 13D). The external orifice 72 of the pipette tip 74 can then be engaged to the back of an electrospray ionization (ESI) chip 52, in order to ionize the sample for analysis by a mass spectrometer 54.

The ESI chip 52 can contain microfabricated nozzles to generate nanoelectrospray ionization of liquid samples at flow rates of 20-500 nl/min. The nanoelectrospray can be initiated by applying the appropriate high voltage to the pipette tip and gas pressure on the testing solution 22. If necessary, each nozzle 52 and pipette tip 74 can be used only once to minimize the possibility of cross-sample contamination. The robotic components of the sampling probe 80 of this embodiment are described in Vilmoz Kertesz and Gary J. Van Berkel, "Fully Automated Liquid Extraction-based Surface Sampling and Ionization Using a Chip-based Robotic Nanoelectrospray Platform," *J. Mass. Spectrom*. Vol. 45, Issue 3, Pages 252-260 (2009), which is hereby incorporated by reference.

The process shown in FIGS. 13A-13E can then be repeated for each of the pins 14 in the array. The ESI chip can provide ions of the sample to a mass spectrometer. The mass spectrometer results for each of the samples can be recorded. The results can then be displayed in the form of a graph showing the distribution of specific chemicals within the specimen. In particular, the sample from each pin in the array can represent one pixel in the graph, which can be a surface. Such a surface plot can be used to map the distribution of a chemical, such as a pharmaceutical, within a tissue to track properties such as efficacy and specificity of the pharmaceutical agent.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

What is claimed is:

1. A system for analyzing a chemical composition of a specimen, comprising:

a plurality of pins closed to liquid flow and each having a tip for contacting a sample and retaining sample over the pin tip, the pins being spaced apart such that sample on one pin does not contact sample on any adjacent pin;

a sampling device configured to contact a liquid with a specimen on the tip of at least one pin to form a testing solution; wherein said sampling device comprises a capillary tube defining an outer perimeter of a capillary in fluid communication with an external orifice of said sampling device, said external orifice for forming a meniscus with a liquid in said capillary tube; the tube having a first position where the orifice is distanced from the pin tip such that liquid does not contact the pin tip; and a mechanism for moving said at least one pin and said sampling device relative to one another to a second position such that sample on a single pin tip contacts the meniscus and sample on the pin tip is transferred into the liquid to create a testing solution.

2. The system according to claim 1, further comprising:

an analytical instrument for determining a chemical composition of said specimen from said testing solution.

3. The system according to claim 2, wherein said sampling device dispenses said testing solution into said analytical instrument.

4. The system according to claim 3, wherein said analytical instrument is a mass spectrometer, an ionization source, a separation method, or a combination thereof.

5. The system according to claim 1, wherein said sampling device further comprises an inner capillary tube disposed within said capillary tube, said inner capillary tube defining an outer perimeter of an inner capillary, wherein said capillary and said inner capillary are in fluid communication at a distal end of said sampling device.

6. The system according to claim 1, wherein said moving mechanism is configured to move said at least one pin and said sampling device such that said sampling device sequentially and individually dissolves samples on more than one pin.

7. The system according to claim 1, wherein a plurality of pins are provided in an array.

8. The system according to claim 7, wherein said array of pins comprises an array of regularly spaced pins.

9. The system according to claim 8, wherein said array of pins has a regular center-to-center spacing in a direction, and wherein a maximum dimension across a distal end of said sampling device in said direction is more than twice said regular spacing in said direction.

10. The system according to claim 1, wherein a tip of said at least one pin comprises at least one of a solid phase microextraction (SPME) coating, taper, a prong and a punch.

* * * * *